US012534993B2

(12) United States Patent
Cornelssen et al.

(10) Patent No.: US 12,534,993 B2
(45) **Date of Patent: *Jan. 27, 2026**

(54) FLOW CROSS JUNCTIONS FOR A MANIFOLD OF A HYDRAULIC FRACTURING SYSTEM AND RELATED METHODS

(71) Applicant: Scout Surface Solutions LLC, Joshua, TX (US)

(72) Inventors: Michael James Cornelssen, Joshua, TX (US); Christopher Mark Koch, Joshua, TX (US)

(73) Assignee: Scout Surface Solutions LLC, Joshua, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/014,114

(22) Filed: Jan. 8, 2025

(65) Prior Publication Data

US 2025/0146396 A1 May 8, 2025

Related U.S. Application Data

(63) Continuation of application No. 18/751,722, filed on Jun. 24, 2024, now Pat. No. 12,228,024, which is a (Continued)

(51) Int. Cl.

| | |
|---|---|
| ***E21B 43/26*** | (2006.01) |
| ***F04B 23/04*** | (2006.01) |
| ***F04B 53/16*** | (2006.01) |

(52) U.S. Cl.

CPC ..... *E21B 43/2607* (2020.05); *F04B 23/04* (2013.01); *F04B 53/16* (2013.01)

(58) Field of Classification Search

CPC ..... E21B 43/2607; F04B 23/04; F04B 53/16

See application file for complete search history.

(56) References Cited

U.S. PATENT DOCUMENTS

| | | |
|---|---|---|
| 5,018,769 A | 5/1991 | Albrecht |
| 8,695,693 B2 | 4/2014 | Nguyen et al. |

(Continued)

FOREIGN PATENT DOCUMENTS

| | | |
|---|---|---|
| CA | 2638434 | 1/2010 |
| CN | 217401115 | 9/2022 |

OTHER PUBLICATIONS

USPTO Invitation to Pay Additional Fees for PCT/US2023/084996, Mar. 6, 2024.

(Continued)

*Primary Examiner* — James G Sayre

(74) *Attorney, Agent, or Firm* — Womble Bond Dickinson (US) LLP

(57) ABSTRACT

An embodiment of a manifold of a hydraulic fracturing system includes a flow cross junction including an inlet flow bore. In addition, the manifold includes a coupling adapter including an external shoulder and a connection device. The connection device is to connect to an output of a pump of the hydraulic fracturing system, and the coupling adapter is removably inserted within the inlet flow bore such that the connection device is positioned outside of the inlet flow bore. Further, the manifold includes a retainer ring connected to the flow cross junction and compressed against the external shoulder.

21 Claims, 21 Drawing Sheets

Related U.S. Application Data continuation of application No. 18/545,963, filed on Dec. 19, 2023, now Pat. No. 12,044,113.

(60) Provisional application No. 63/512,219, filed on Jul. 6, 2023, provisional application No. 63/512,193, filed on Jul. 6, 2023, provisional application No. 63/491,139, filed on Mar. 20, 2023, provisional application No. 63/476,438, filed on Dec. 21, 2022.

(56) References Cited

U.S. PATENT DOCUMENTS 8,794,306 B2 8/2014 Cote et al.
8,851,182 B2 10/2014 Nguyen et al.
8,899,315 B2 12/2014 Nguyen et al.
8,944,159 B2 2/2015 Guidry et al.
8,960,307 B2 2/2015 Cain et al.
8,978,763 B2 3/2015 Guidry
9,045,960 B2 6/2015 Vanderford et al.
9,068,450 B2 6/2015 Guidry
9,115,562 B2 8/2015 Guidry et al.
9,133,677 B2 9/2015 Cain et al.
9,376,883 B2 6/2016 Nguyen et al.
9,382,774 B2 7/2016 Vogel et al.
9,416,614 B2 8/2016 Cain et al.
9,518,430 B2 12/2016 Guidry
9,677,698 B2 6/2017 Nguyen et al.
9,719,312 B2 8/2017 Vanderford et al.
9,850,743 B2 12/2017 Harkins et al.
9,869,150 B2 1/2018 Cote et al.
9,932,800 B2 4/2018 Guidry
9,976,372 B2 5/2018 Guidry
10,053,946 B2 8/2018 Nguyen et al.
10,094,195 B2 10/2018 Guidry
10,132,146 B2 11/2018 Guidry
10,138,697 B2 11/2018 Guidry
10,151,167 B2 12/2018 Cain et al.
10,156,122 B2 12/2018 Nguyen et al.
10,295,071 B2 5/2019 Ngueyn
10,385,643 B2 8/2019 Guidry
10,385,644 B2 8/2019 Guidry et al.
10,385,645 B2 8/2019 Guidry
10,400,545 B2 9/2019 Shirley et al.
10,422,483 B2 9/2019 Cook
10,428,614 B2 10/2019 Guidry et al.
10,458,216 B2 10/2019 Hefley
10,480,300 B2 11/2019 Guidry
10,487,637 B2 11/2019 Guidry et al.
10,538,987 B2 1/2020 Guidry et al.
10,655,934 B2 5/2020 Flaster et al.
10,711,556 B1 7/2020 Guidry et al.
10,738,556 B2 8/2020 Guidry et al.
10,876,371 B2 12/2020 Guidry
10,876,376 B2 12/2020 Robinson et al.
10,961,800 B2 3/2021 Guidry
10,961,801 B2 3/2021 Christopherson et al.
10,961,802 B2 3/2021 Guidry
10,982,522 B1 * 4/2021 Hill ..... F16L 41/03
10,995,561 B1 5/2021 Travix et al.
11,015,413 B2 5/2021 Guidry
11,060,375 B2 7/2021 Shirley et al.
11,066,913 B2 7/2021 Guidry et al.
11,193,360 B1 12/2021 Yeung et al.
11,193,361 B1 12/2021 Yeung et al.
11,306,835 B1 4/2022 Dille et al.
11,319,757 B2 5/2022 Robinson et al.
11,391,109 B2 7/2022 Guidry
11,434,739 B2 9/2022 Guidry
11,513,500 B2 11/2022 Jaaskelainen et al.
11,725,460 B2 8/2023 Robinson et al.
11,732,542 B2 8/2023 Hughes
11,753,890 B2 9/2023 Chapman et al.
11,753,911 B1 9/2023 Kabrich et al.
11,828,148 B2 11/2023 Guidry
11,834,941 B2 12/2023 Guidry
11,859,480 B2 1/2024 Kabrich et al.
11,867,043 B1 1/2024 Adams et al.
11,885,207 B2 1/2024 Garro et al.
11,898,411 B2 2/2024 Guidry
11,920,450 B2 3/2024 Yeung et al.
11,970,920 B2 4/2024 Guidry et al.
11,976,534 B2 5/2024 Guidry et al.
12,000,254 B1 6/2024 Colley, III et al.
12,044,092 B2 7/2024 Guidry et al.
12,044,113 B2 7/2024 Cornelssen et al.
12,060,783 B2 8/2024 Krupa et al.
12,091,955 B2 9/2024 Cornelssen et al.
12,098,783 B2 9/2024 Chen et al.
12,134,948 B2 11/2024 Guidry et al.
12,146,399 B2 11/2024 Cornelssen et al.
12,228,024 B2 2/2025 Cornelssen
12,492,625 B1 12/2025 Chappell et al.
2004/0154790 A1 8/2004 Cornelssen
2007/0114039 A1 5/2007 Hobdy et al.
2012/0085532 A1 4/2012 McGuire
2014/0060806 A1 3/2014 Nguyen et al.
2014/0246192 A1 9/2014 Guidry
2015/0136383 A1 5/2015 Guidry et al.
2016/0348468 A1 12/2016 Blacklock
2017/0138144 A1 5/2017 Christopherson et al.
2017/0198548 A1 7/2017 Dickinson
2018/0073346 A1 3/2018 Urdaneta
2018/0119853 A1 5/2018 Guidry et al.
2018/0283102 A1 10/2018 Cook
2019/0024829 A1 1/2019 Potier
2020/0088021 A1 3/2020 Guidry
2020/0103078 A1 4/2020 Scott et al.
2020/0109804 A1 4/2020 Nguyen
2020/0362666 A1 11/2020 Tran
2021/0071503 A1 3/2021 Ogg et al.
2021/0108758 A1 4/2021 Loven
2021/0164313 A1 6/2021 Guidry et al.
2021/0317722 A1 10/2021 Affleck et al.
2021/0388931 A1 12/2021 George et al.
2022/0049802 A1 2/2022 Choate et al.
2022/0112796 A1 4/2022 Jaaskelainen et al.
2022/0186568 A1 6/2022 Westgarth
2022/0222395 A1 7/2022 Song et al.
2023/0041790 A1 2/2023 Elliott et al.
2023/0100479 A1 3/2023 Roesner et al.
2023/0119473 A1 4/2023 Roesner et al.
2023/0167709 A1 6/2023 Beason et al.
2023/0175341 A1 6/2023 Guidry
2023/0341061 A1 10/2023 Bull
2024/0117725 A1 4/2024 Adams et al.
2024/0209720 A1 6/2024 Cornelssen
2024/0209721 A1 6/2024 Cornelssen
2024/0337178 A1 10/2024 Cornelssen et al.
2024/0344439 A1 10/2024 Cornelssen et al.
2024/0384637 A1 11/2024 Bolen et al.
2025/0034976 A1 1/2025 Cornelssen

OTHER PUBLICATIONS

USPTO Invitation to Pay Additional Fees for PCT/US2023/084998, Mar. 6, 2024.
International Search Report and Written Opinion for international application No. PCT/US2023/084998, mailed on May 22, 2024.
International Search Report and Written Opinion for international application No. PCT/US2023/084996, mailed on May 22, 2024.
Choke Relief Valves, CorTec, retrieved at https://uscortec.com/products/choke-relief-valves/.
International Search Report and Written Opinion for international application No. PCT/US2025/043657, mailed on Oct. 20, 2025.

* cited by examiner

FLOW CROSS JUNCTIONS FOR A MANIFOLD OF A HYDRAULIC FRACTURING SYSTEM AND RELATED METHODS

CROSS REFERENCE TO RELATED APPLICATIONS

This application is a continuation of U.S. Non-Provisional application Ser. No. 18/751,722, filed Jun. 24, 2024, titled "FLOW CROSS JUNCTIONS FOR A MANIFOLD OF A HYDRAULIC FRACTURING SYSTEM AND RELATED METHODS," now U.S. Pat. No. 12,228,024, issued Feb. 18, 2025, which is a continuation of U.S. Non-Provisional application Ser. No. 18/545,963, filed Dec. 19, 2023, titled "FLOW CROSS JUNCTIONS FOR A MANIFOLD OF A HYDRAULIC FRACTURING SYSTEM AND RELATED METHODS," now U.S. Pat. No. 12,044,113, issued Jul. 23, 2024, which claims priority to, and the benefit of U.S. Provisional Application No. 63/512,219, filed Jul. 6, 2023, titled "FLUID COUPLING ASSEMBLIES FOR A MANIFOLD OF A HYDRAULIC FRACTURING SYSTEM AND RELATED METHODS," U.S. Provisional Application No. 63/512,193, filed Jul. 6, 2023, titled "FLOW CROSS JUNCTIONS FOR A MANIFOLD OF A HYDRAULIC FRACTURING SYSTEM AND RELATED METHODS," U.S. Provisional Application No. 63/491,139, filed Mar. 20, 2023, titled "FLOW CROSS JUNCTIONS FOR A MANIFOLD OF A HYDRAULIC FRACTURING SYSTEM AND RELATED METHODS," and U.S. Provisional Application No. 63/476,438, filed Dec. 21, 2022, titled "FLUID COUPLING ASSEMBLIES FOR A MANIFOLD OF A HYDRAULIC FRACTURING SYSTEM AND RELATED METHODS," the disclosures of which are incorporated herein by reference in their entireties. U.S. Non-Provisional application Ser. No. 18/545,963 is also related to U.S. Non-Provisional application Ser. No. 18/545,946, filed Dec. 19, 2023, titled "FLUID COUPLING ASSEMBLIES FOR A MANIFOLD OF A HYDRAULIC FRACTURING SYSTEM AND RELATED METHODS," now U.S. Pat. No. 12,091,955, issued Sep. 17, 2024, the disclosure of which is incorporated herein by reference in its entirety.

BACKGROUND

During a hydraulic fracturing operation, a pressurized fracturing fluid is injected into a subterranean formation via a wellbore or multiple wellbores. The injected fracturing fluid is at a higher pressure than the fracture pressure of the subterranean formation such that the fluid creates fractures therein. The fractures increase a permeability of the subterranean formation so that formation fluids (such as oil, gas, water, etc.) may more easily escape the subterranean formation and flow to the surface via the wellbore(s). Proppant (such as sand or other solids) may be mixed with the fracturing fluid prior to injecting the fracturing fluid downhole. The proppant may flow into the fractures in the subterranean formation to hold the fractures open after the hydraulic fracturing operation has ended.

Various fluid conveyance devices and systems are positioned at the surface to route the fracturing fluids into and out of the wellbore(s) during the hydraulic fracturing operation. The fluid conveyance devices may include various combinations of pipes, hoses, conduits, manifolds, tanks, pumps, etc. At least some of these devices transport the fracturing fluid after it has been pressurized into the wellbore(s). Thus, the fluid conveyance devices (or some of the fluid conveyance devices) are configured to withstand relatively high differential pressures during operations. However, due to the severe conditions of a hydraulic fracturing operation, failures of these fluid conveyance devices are common.

BRIEF SUMMARY

As previously described, during a hydraulic fracturing operation, various fluid conveyance devices may be used to route and contain relatively high-pressure fracturing fluid during operations. For instance, one such fluid conveyance device includes a fluid manifold for receiving the pressurized fluid from one or more pumps. Such manifolds are sometimes referred to as "missiles." The manifold may include one or more flow cross junctions having one or more fluid inlets for receiving the pressurized fluid output from the one or more pumps. Each inlet may include a fluid coupling that connects to an output of a corresponding pump via a suitable conduit. Conventionally, the fluid couplings are attached to the flow cross junctions of the manifold via large, flanged connections. In order to accommodate these flanged connections and maintain a sufficient wall thickness around the internal flow bores (or passages) of the flow cross junction (for withstanding the high pressures of the fracturing fluid), the body of the flow cross junction may be substantial in both dimension and weight. This, in turn, greatly increases the size and weight of the manifold (which may employ a number of flow cross junctions as previously described) such that the manifold occupies a relatively large percentage of the limited available space at the wellsite, and the use of larger (and therefore expensive) lifting and support equipment is necessitated for construction, deconstruction, and repair of the manifold and its components.

In addition, the fluid couplings represent a weak point in the manifold and routinely experience failure due to the high pressures of the fracturing fluid, the vibrations within the system (such as vibrations caused by operation of the pump(s)), and the erosive nature of the proppant entrained within the high-pressure fracturing fluid. However, removal and replacement of these fluid couplings can be cumbersome and time consuming especially when a conventional flanged connection is employed. Thus, a failure of a fluid coupling on the high-pressure manifold can lead to a significant delay in the hydraulic fracturing operation and an associated increase in the cost and time associated with the hydraulic fracturing operation.

Accordingly, some embodiments disclosed herein include flow cross junctions for a manifold of a hydraulic fracturing system that include a streamlined shape and design so as to allow for a significant reduction in size and weight for the flow cross junctions and manifold overall. In addition, some embodiments disclosed herein include fluid coupling assemblies for a manifold of a hydraulic fracturing system that facilitate quick replacement in the event of a failure so as to minimize stoppage time. In some embodiments, the embodiments disclosed herein include a fluid coupling assembly having a removable coupling adapter that is inserted directly within an inlet flow bore of the flow cross junction. Thus, by configuring the coupling adapter so that it may be easily removed and replaced, the downtime associated with the replacement of a failed fluid coupling on the manifold may be reduced. As a result, through use of the embodiments disclosed herein, a hydraulic fracturing operation may be conducted more safely and efficiently.

Some embodiments disclosed herein are directed to a method including (a) inserting a coupling adapter into an inlet flow bore of a flow cross junction of a manifold of a hydraulic fracturing system. In addition, the method includes (b) positioning a connection device of the coupling adapter outside of the inlet flow bore as a result of (a). The connection device to connect to an output of a pump of the hydraulic fracturing system. Further, the method includes (c) compressing a retainer ring against an external shoulder of the coupling adapter.

Some embodiments disclosed herein are directed to a manifold of a hydraulic fracturing system. In some embodiments, the manifold includes a flow cross junction including an inlet flow bore. In addition, the manifold includes a coupling adapter including an external shoulder and a connection device. The connection device is to connect to an output of a pump of the hydraulic fracturing system, and the coupling adapter is removably inserted within the inlet flow bore such that the connection device is positioned outside of the inlet flow bore. Further, the manifold includes a retainer ring connected to the flow cross junction and compressed against the external shoulder.

In some embodiments, the manifold includes a first elongate manifold section. In addition, the manifold includes a second elongate manifold section. Further, the manifold includes a flow cross junction positioned between the first elongate manifold section and the second elongate manifold section along a longitudinal axis. The flow cross junction includes a first end connected to the first elongate manifold section. In addition, the flow cross junction includes a second end connected to the second elongate manifold section. Further, the flow cross junction includes a throughbore extending axially between the first end and the second end. Still further, the flow cross junction includes an outer surface extending axially between the first end and the second end. The outer surface has an outer diameter that is greater than an axial length of the flow cross junction measured from the first end to the second end along the longitudinal axis. Also, the flow cross junction includes an inlet flow bore extending between the outer surface and the throughbore.

Some embodiments disclosed herein are directed to a flow cross junction for a manifold of a hydraulic fracturing system. In some embodiments, the flow cross junction includes an upstream end configured to connect with a first elongate manifold section. In addition, the flow cross junction includes a downstream end spaced from the upstream end along a longitudinal axis to define an axial length of the flow cross junction measured axially from the upstream end to the downstream end. The downstream end is configured to connect to a second elongate manifold section. Further, the flow cross junction includes a throughbore extending axially between the upstream end to the downstream end. Still further, the flow cross junction includes an outer surface extending axially between the upstream end to the downstream end. The outer surface has an outer diameter that is greater than the axial length of the flow cross junction.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those having ordinary skill in the art upon reading the following detailed description, and by referring to the accompanying drawings. It should be appreciated that this disclosure may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various embodiments, reference will now be made to the accompanying drawings in which.

DETAILED DESCRIPTION

Figure 1:
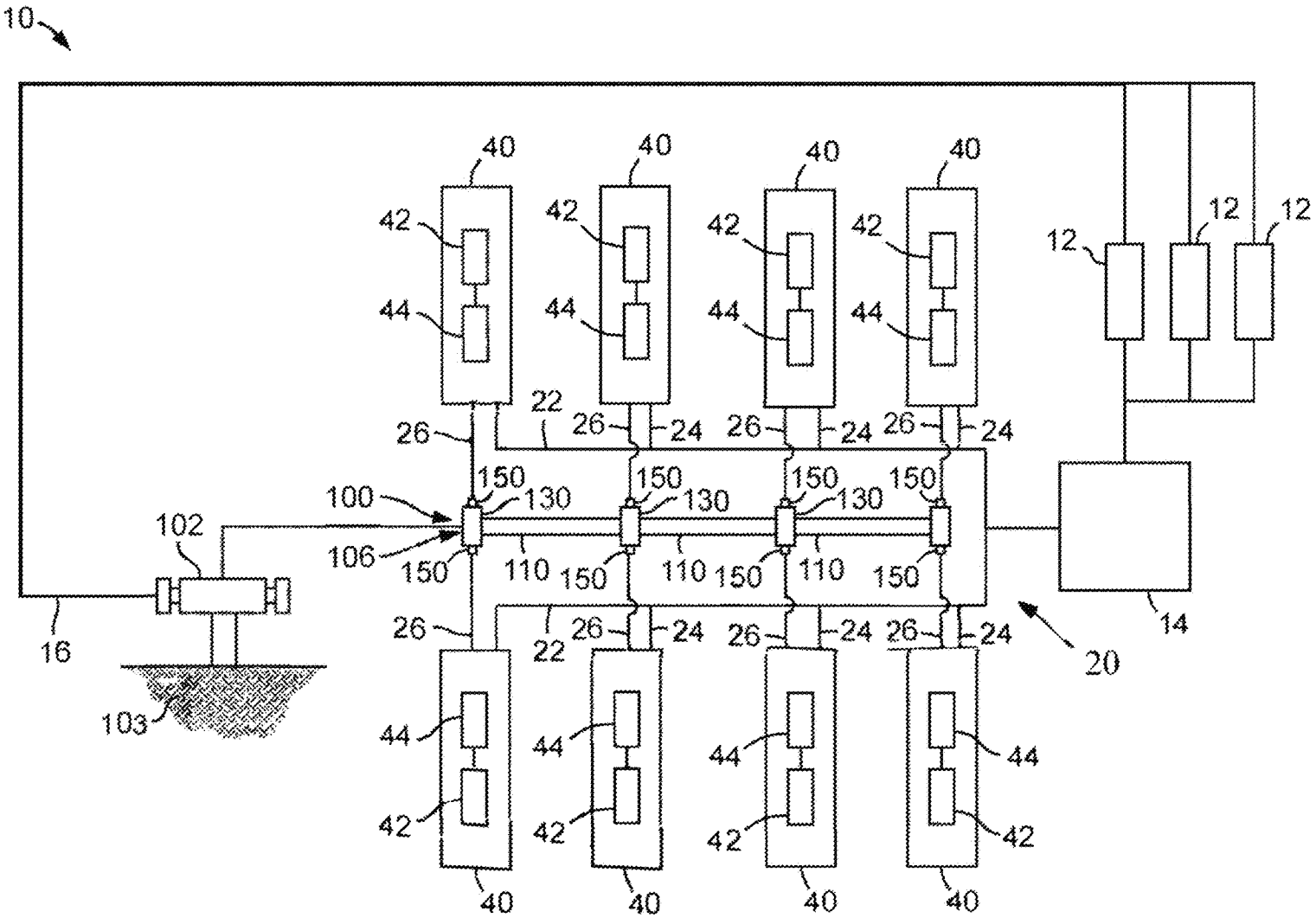
FIG. 1 is a schematic diagram of a hydraulic fracturing system including a manifold having one or more flow cross junctions according to some embodiments of the disclosure.

As previously described, during a hydraulic fracturing operation, various fluid conveyance devices may be used to route and contain relatively high-pressure fracturing fluid during operations. For instance, one such fluid conveyance device includes a fluid manifold for receiving the pressurized fluid from one or more pumps. Such manifolds are sometimes referred to as "missiles." The manifold may include one or more flow cross junctions that further include one or more fluid inlets (or "inlet flow bores") for receiving the pressurized fluid output from the one or more pumps. Each fluid inlet may include a fluid coupling that connects to an output of a corresponding pump via a suitable conduit. Such fluid couplings represent a weak point in the manifold and routinely experience failure due to the high pressures of the fracturing fluid, the vibrations within the system (such as vibrations caused by operation of the pump(s)), and the erosive nature of the proppant entrained within the high-pressure fracturing fluid. However, removal and replacement of these fluid couplings can be cumbersome and time consuming. Thus, a failure of a fluid coupling on the high-pressure manifold can lead to a significant delay in the hydraulic fracturing operation and an associated increase in the cost and time associated with the hydraulic fracturing operation.

In addition, a conventional flow cross junction may be relatively large and bulky so as to accommodate the conventional flanged connections of the fluid couplings and to provide sufficient wall thicknesses for the internal flow bores to contain the high-pressure fracturing fluid during operations. However, these large, conventional flow cross junctions substantially increases the total weight of the high-pressure manifold thereby further increasing the costs of these components and the complexity (and inherent dangers) for moving these components about the wellsite.

Accordingly, embodiments disclosed herein include flow cross junctions for a manifold of a hydraulic fracturing system that include a streamlined shape and design so as to allow for a significant reduction in size and weight for the flow cross junctions and manifold overall. In addition, some embodiments of the flow cross junctions disclosed herein include fluid couplings that facilitate quick replacement in the event of a failure so as to minimize stoppage time. In some embodiments, the embodiments disclosed herein include a fluid coupling assembly having a removable coupling adapter that is inserted directly within the flow cross junction of the manifold so as to omit the large, flanged connections associated with a conventional fluid coupling. As will be described in more detail below, the coupling adapter may be the component of the fluid coupling assembly having the highest likelihood of failure. Thus, by configuring the coupling adapter so that it may be easily removed and replaced, the downtime associated with the replacement of a failed fluid coupling on the manifold may be reduced. As a result, through use of the embodiments disclosed herein, a hydraulic fracturing operation may be conducted more safely and efficiently.

FIG. 1 shows a schematic diagram of a hydraulic fracturing system 10 including a manifold 100 having one or more flow cross junction 130 according to some embodiments. During operations, system 10 may inject a high-pressure fracturing fluid into a wellhead 102 that is connected to a wellbore (not shown) extending into a subterranean formation 103 to fracture the subterranean formation 103 as previously described. In some embodiments, the system may inject the high-pressure fracturing fluid into a plurality of wellheads so as to access the subterranean formation 103 via a plurality of wellbores.

It should be appreciated that the hydraulic fracturing system 10 shown in FIG. 1 depicts some components and assemblies that may be used during a hydraulic fracturing operation, and that in some embodiments additional or fewer components may be used within the system 10. Thus, the particular combination and/or arrangement of components of the system 10 depicted in FIG. 1 is not limiting to other potential embodiments of system 10.

System 10 generally includes a plurality of storage vessels 12 that are each configured to hold a volume of fracturing fluid therein. The fracturing fluid stored in the storage vessels 12 may include any liquid or semi-liquid (such as a gel) that is suitable for injection into and fracturing of the subterranean formation 103 as previously described. In some embodiments, the fracturing fluid includes an aqueous solution including substantially pure water or water mixed with one or more additives (such as gels or gelling agents, chemicals, etc.). The storage vessels 12 may include any suitable container for holding a volume of fluids (such as liquids) therein. For instance, in some embodiments, storage vessels may include rigid tanks, flexible tanks (such as bladders), open pits, mobile tanks (that may be pulled by a tractor trailer or other vehicle), or a combination thereof.

A blender 14 is positioned downstream of the storage vessels 12 that is configured to mix a proppant into the fracturing fluid. The proppant may include sand or other suitable solids. As previously described, the proppant is configured to flow into the fractures within the subterranean formation 103 so as to hold the fractures open after the hydraulic fracturing operation has ended. In some embodiments, additives (such as chemical additives) may be mixed into the fracturing fluid within the blender 14 either in addition or alternatively to the proppant. The blender 14 emits the fracturing fluid, now with proppant mixed therein, to a manifold assembly 20 that communicates the fracturing fluid to and from a plurality of pumping units 40.

The manifold assembly 20 includes one or more low-pressure, inlet manifolds 22 and one or more high-pressure, outlet manifolds 100. In the particular embodiment depicted in FIG. 1, manifold assembly 20 includes two inlet manifolds 22 and a single outlet manifold 100. However, in other embodiments, different numbers, arrangements, and combinations of inlet manifolds 22 and outlet manifolds 100 may be utilized, such as, for instance, a single outlet manifold 100, a plurality of outlet manifolds 100, a single inlet manifold 22, or a plurality of inlet manifolds 22. A plurality of inlet conduits 24 connect the inlet manifolds 22 to the plurality of pumping units 40. In addition, a plurality of outlet conduits 26 connect the plurality of pumping units 40 to the outlet manifold 100.

Each pumping unit 40 includes a pump 44 driven by a driver 42 (which may be referred to herein as a "prime mover"). Pump 44 may include any suitable fluid pumping device or assembly for pressurizing the fracturing fluid (with or without proppant and/or other additives entrained therein) to the pressures associated with a hydraulic fracturing operation. For instance, in some embodiments, the pump 44 may be configured to pressurize the fracturing fluid (again, with or without proppant and/or other additives entrained therein) to a pressure of about 9000 pounds per square inch (psi) or higher. Thus, pump 44 may be referred to herein as a "hydraulic fracturing pump" 44. In some embodiments, pump 44 may include a positive displacement pump, centrifugal pump, or other suitable pump types. Driver 42 may include any suitable motor or engine that is configured to drive or actuate the corresponding pump 44 during operations. For instance, in some embodiments, driver 42 may include a diesel engine, a turbine (such as a gas turbine, steam turbine, etc.), an electric motor, or some combination thereof. During operations, within each pumping unit 40, the driver 42 may actuate the pump 44 to draw fracturing fluid into the pump 44 via the corresponding inlet conduit 24 and to pressurize and output the fracturing fluid from the pump 44 via the corresponding outlet conduit 26.

The outlet manifold 100 is described in more detail below. However, generally speaking the pressurized fracturing fluid is received by the outlet manifold 100 via the outlet conduits 26. The outlet manifold 100 directs the pressurized fracturing fluid toward the wellhead 102 such that it may access the subterranean formation 103 as previously described. During the hydraulic fracturing operations, fracturing fluid may be emitted from the wellbore via the wellhead 102 and recycled back to the storage vessels 12 through one or more recycle conduits 16. In some embodiments, the fracturing fluid output from the wellhead 102 may be routed through one or more filtering or separation assemblies or devices (not shown) to remove additives, proppant, and/or other fluids or solids (such as, rock chips, formation fluids, etc.) that may be entrained within the fracturing fluid, prior to recycling the fracturing fluid to the storage vessels 12.

Figure 2:
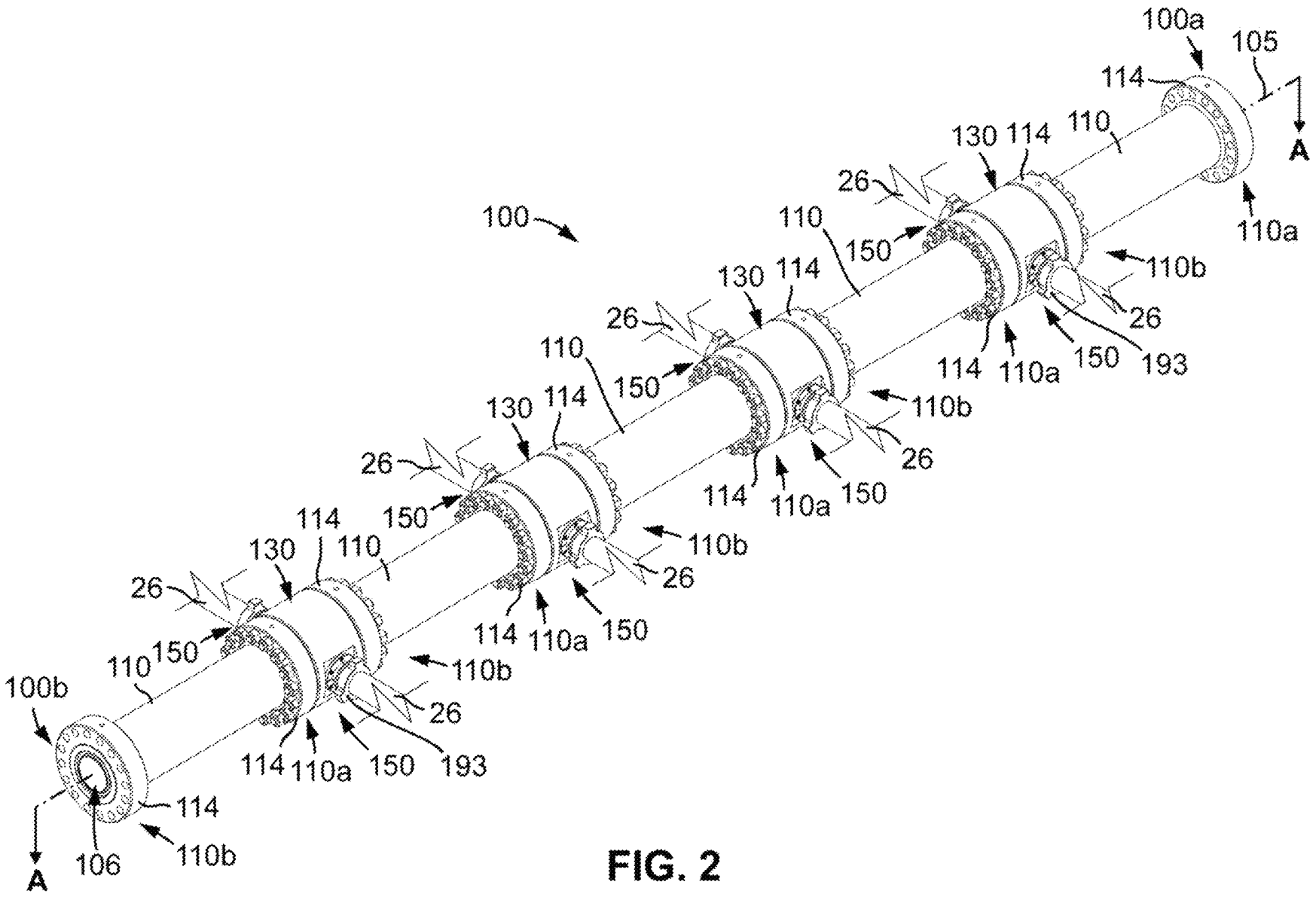
FIG. 2 is a perspective view of an outlet manifold of the hydraulic fracturing system of FIG. 1 according to some embodiments of the disclosure.
Figure 3:
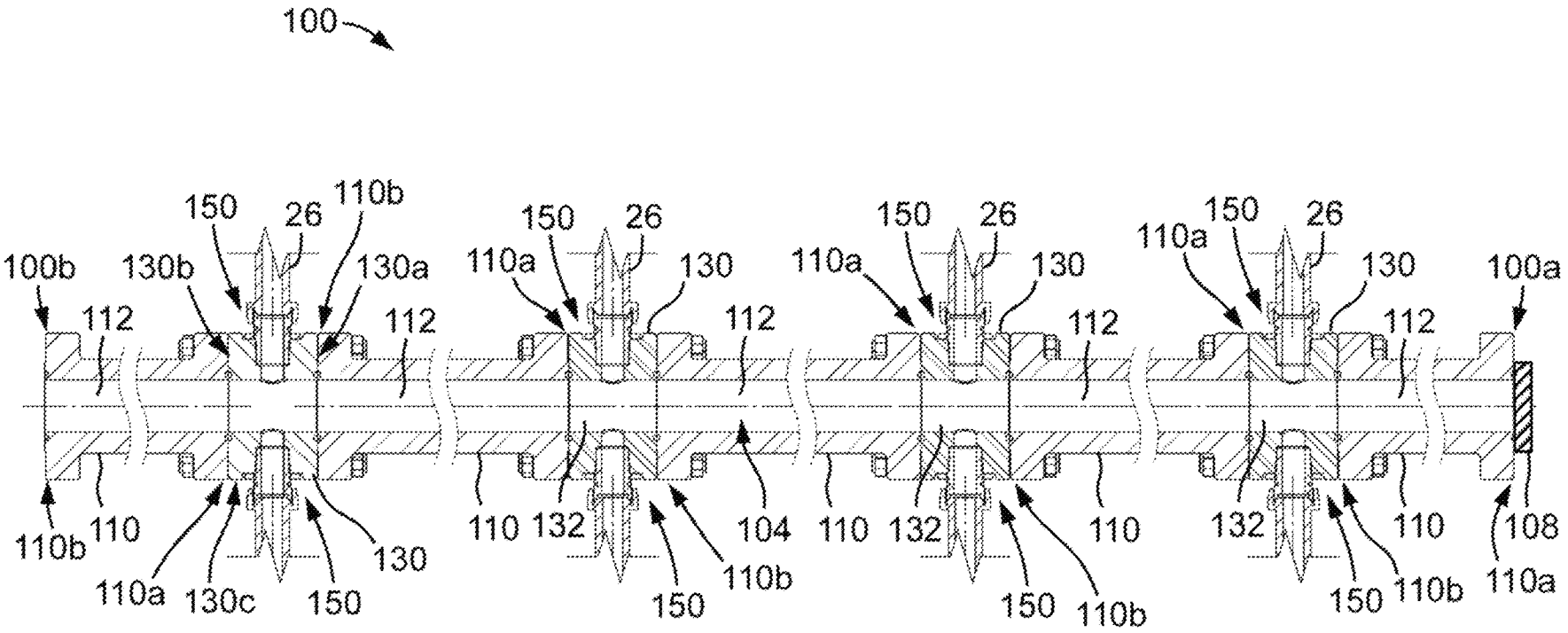
FIG. 3 is a cross-sectional view of the manifold of FIG. 2 taken along section A-A in FIG. 2 according to some embodiments of the disclosure.

FIGS. 2 and 3 show the outlet manifold 100 of hydraulic fracturing system 10 of FIG. 1 according to some embodiments. The outlet manifold 100 is an elongate member having a central or longitudinal axis 105, a first or upstream end 100*a*, and a second or downstream end 100*b* opposite upstream end 100*a*. As used herein, the terms "upstream" and "downstream" are used to denote the general flow direction of fracturing fluid through the outlet manifold 100 during operations, according to some embodiments. This convention is used herein for clarity and convenience when describing the outlet manifold 100 and the components and assemblies thereof. An outlet 106 is positioned at the downstream end 100*b* that is fluidly connected to the wellhead 102 (FIG. 1).

In addition, outlet manifold 100 includes a plurality of tubular manifold sections 110 and a plurality of flow cross junctions 130 interleaved between the plurality of manifold sections 110 along the longitudinal axis 105. More particularly, each manifold section 110 extends axially between axially adjacent flow cross junctions 130.

Manifold sections 110 are elongate tubular members that are coaxially aligned along the longitudinal axis 105 (so that the manifold sections 110 may be referred to herein as "elongate manifold sections"). As is best shown in FIG. 3, each manifold section 110 includes a first or upstream end 110*a*, a second or downstream end 110*b* opposite upstream end 110*a*, and a throughbore 112 extending axially between the ends 110*a*, 110*b*. Some of the ends 110*a*, 110*b* are connected to an axially adjacent flow cross junction 130 along outlet manifold 100. For instance, at least one of the ends 110*a*, 110*b* of each manifold section 110 may be connected to a corresponding, axially adjacent flow cross junction 130 via flanges 114; however, other connection mechanisms are contemplated (such as a threaded connection, clamped connection, welded connection, etc.).

Figure 4:
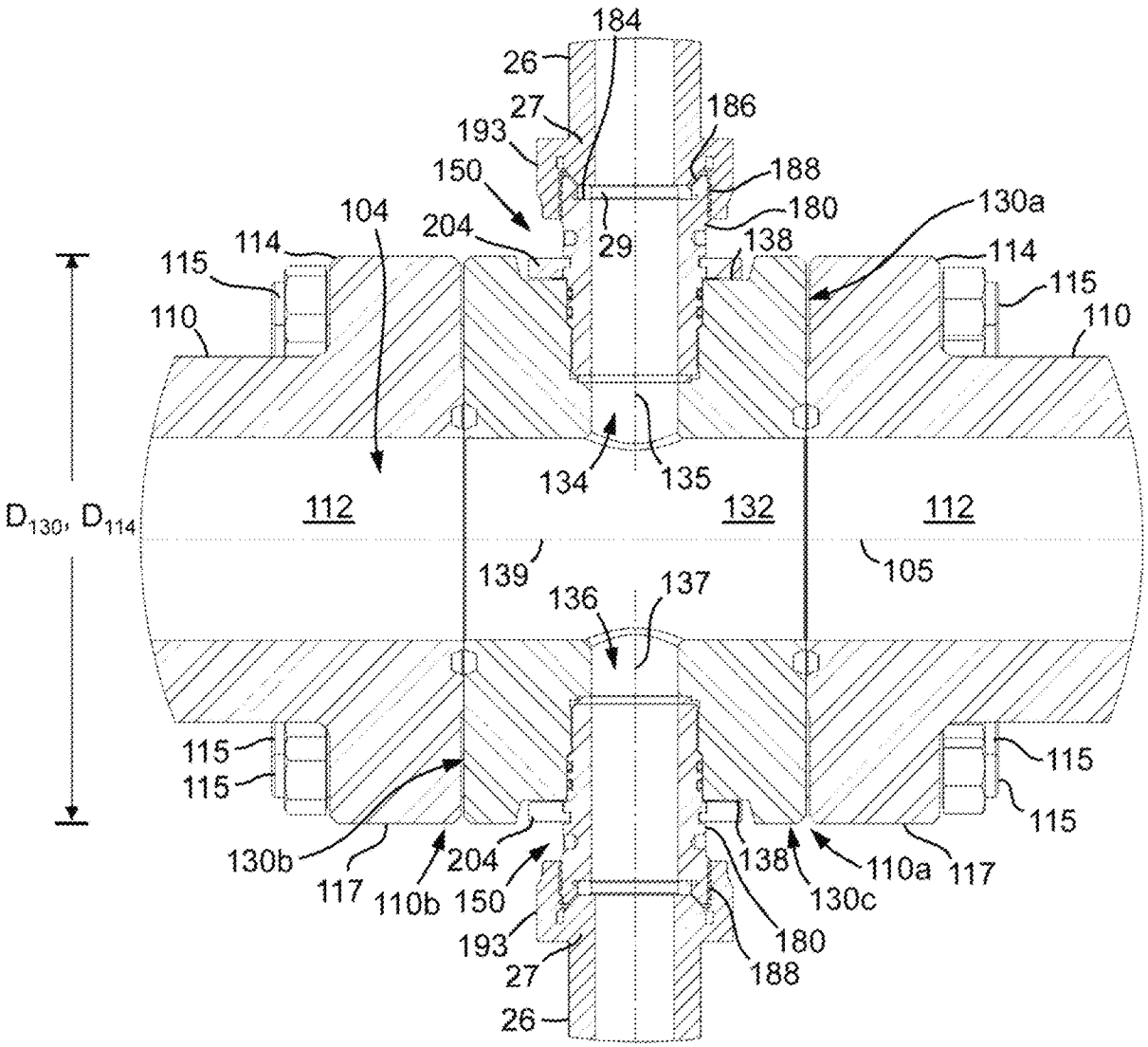
FIG. 4 is an enlarged side cross-sectional view of one of the flow cross junctions of the manifold of FIG. 2 according to some embodiments of the disclosure.

As shown in FIGS. 2-4, flow cross junctions 130 are axially spaced along longitudinal axis 105 and axially interleaved between the plurality of manifold sections 110 as previously described. During operations, the flow cross junctions 130 provide a plurality of inlets for pressurized fracturing fluid to enter the outlet manifold 100. As best shown in FIG. 4, each flow cross junction 130 includes a central axis 139 that is aligned with longitudinal axis 105 when flow cross junction 130 is connected within manifold 100. In addition, flow cross junction 130 includes a first or upstream end 130*a*, a second or downstream end 130*b* opposite upstream end 130*a*, and a radially outer surface 130*c* (or more simply "outer surface" 130*c*) extending axially between ends 130*a*, 130*b* relative to axis 139. A first or main flow bore 132 extends axially between the ends 130*a*, 130*b* relative to axis 139. The main flow bores 132 of flow cross junctions 130 are aligned and fluidly connected with the throughbores 112 of the axially adjacent manifold sections 110 along outlet manifold 100 such that the throughbores 112 and main flow bores 132 together define a manifold flow path 104 that extends through the outlet manifold 100 between the upstream end 100*a* and the downstream end 100*b* (and outlet 106) along axis 105 of manifold 100.

As shown in FIG. 3, in some embodiments, the manifold flow path 104 may be blocked by a blind or cap 108 at the upstream end 100*a* of outlet manifold 100 so that fracturing fluid may not flow out of outlet manifold 100 via the upstream end 100*a*. In the embodiment shown in FIG. 3, the upstream end 100*a* is defined by an upstream end 110*a* of one of the manifold sections 110. In some embodiments, the upstream end 100*a* of outlet manifold 100 may be defined by an upstream end 130*a* of one of the flow cross junctions 130 (such as the most upstream of the flow cross junctions 130). In some of these embodiments, the main flow bore 132 of the flow cross junction 130 defining or including the upstream end 100*a* of outlet manifold 100 may not extend fully to upstream end 100*a* (and the corresponding upstream end 130*a*) and cap 108 may be omitted. In addition, the downstream end 100*b* of outlet manifold 100 may define the outlet 106 of the manifold flow path 104. Specifically, in some embodiments, the downstream end 100*b* is defined by a downstream end 110*b* of one of the manifold sections 110. In some embodiments, the downstream end 100*b* may be defined by a downstream end 130*b* of one of the flow cross junctions 130 (such as the most downstream of the flow cross junctions 130).

In addition, as shown in FIG. 4, each flow cross junction 130 includes a plurality of inlet flow bores 134, 136 that extend from the radially outer surface 130*c* to the main flow bore 132. In particular, in some embodiments, a first inlet flow bore 134 and a second inlet flow bore 136 each extend radially from radially outer surface 130*c* to main flow bore 132 relative to axis 139 and axis 105. The inlet flow bores 134, 136 of the flow cross junctions 130 provide inlet flow paths into the manifold flow path 104 for the fracturing fluid output from the plurality of pumping units 40 during operations (FIG. 1).

Figure 5:
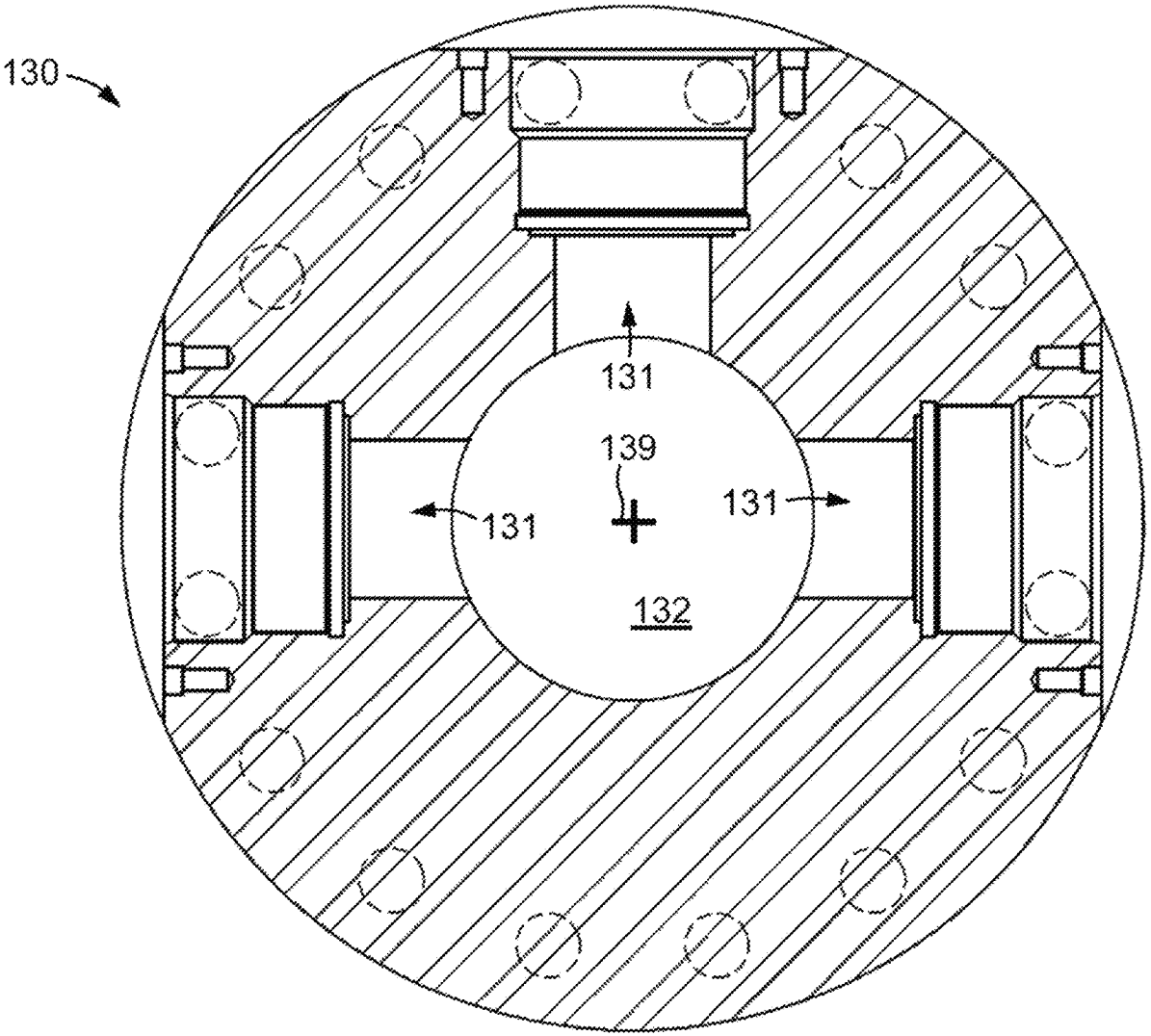
FIG. 5 is a cross-sectional view of an embodiment of a flow cross junction including three inlet flow bores that is taken along a plane extending radially through a longitudinal axis of the flow cross junction according to some embodiments of the disclosure.
Figure 6:
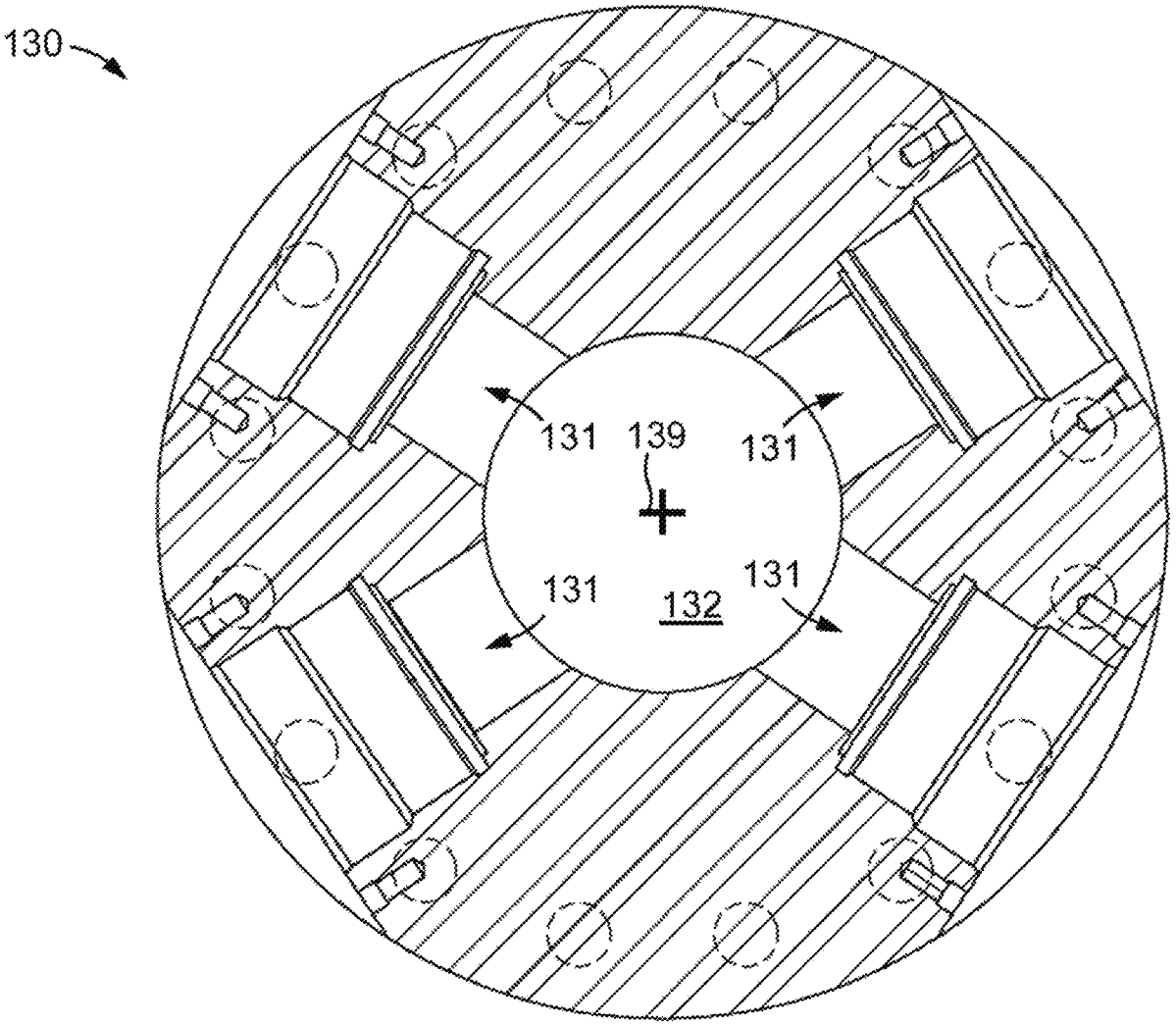
FIG. 6 is a cross-sectional view of an embodiment of a flow cross junction including four inlet flow bores that is taken along a plane extending radially through a longitudinal axis of the flow cross junction according to some embodiments of the disclosure.
Figure 7:
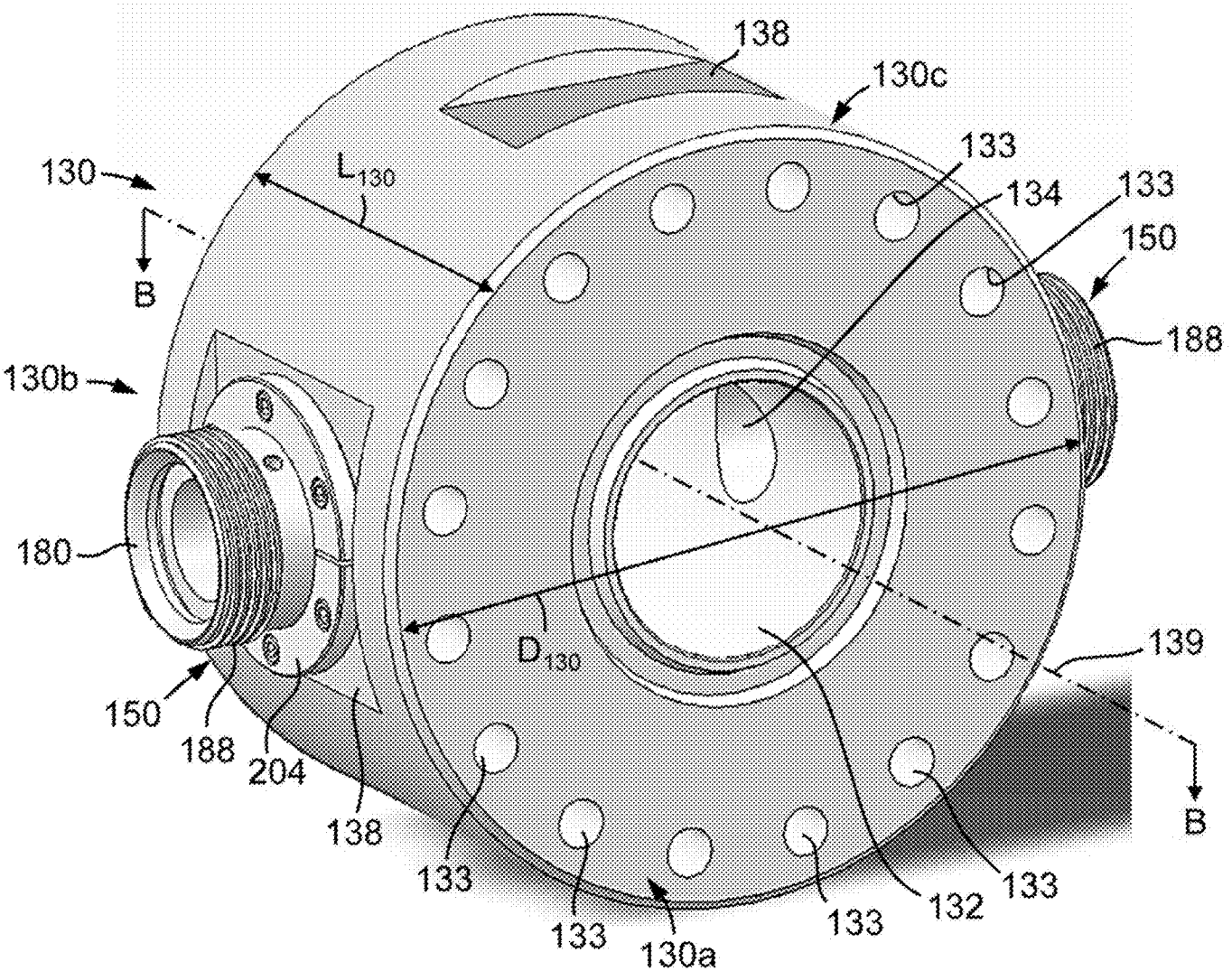
FIG. 7 is a perspective view of one of the flow cross junctions of the manifold of FIG. 2 according to some embodiments of the disclosure.
Figure 8:
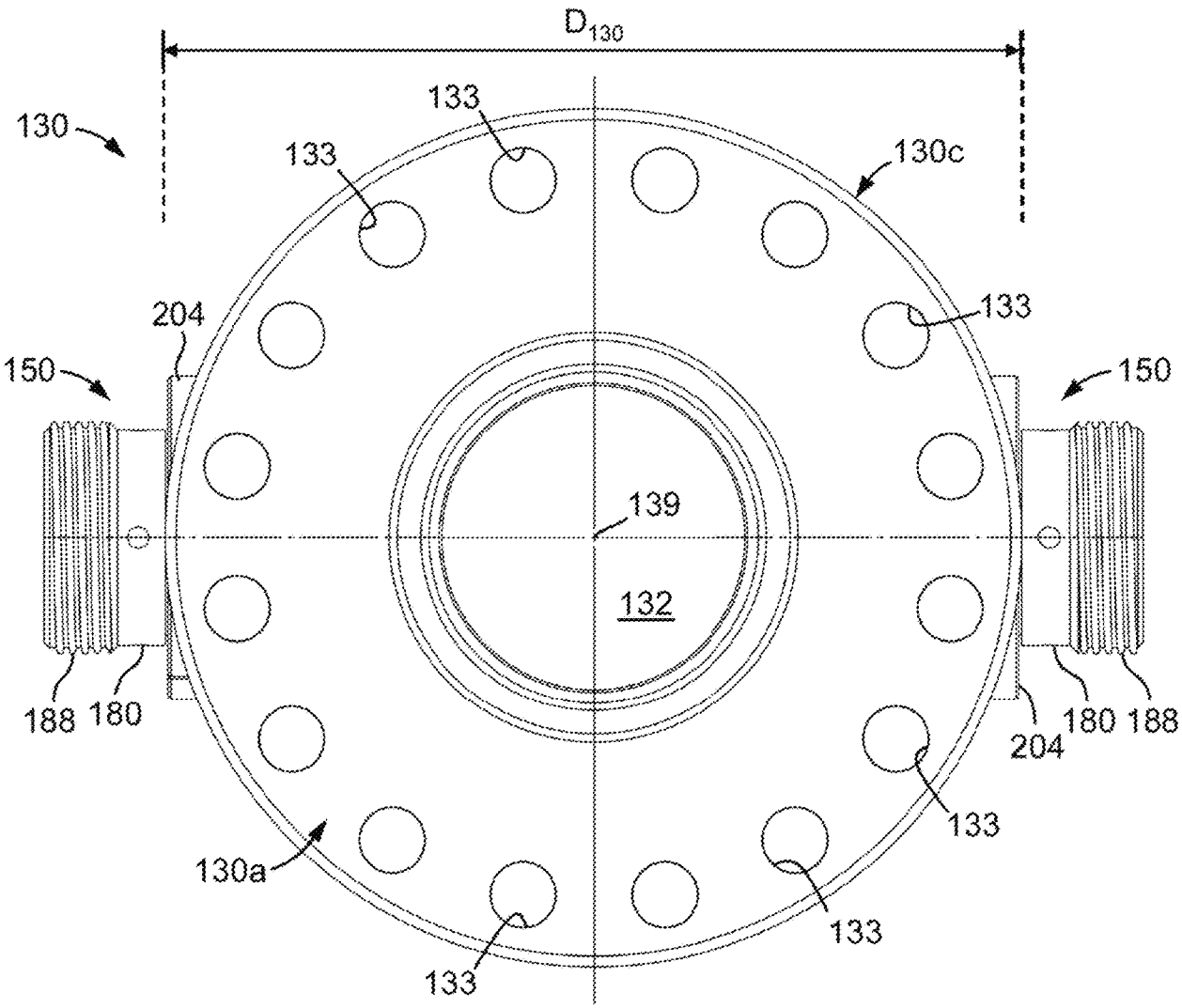
FIG. 8 is a side view of the flow cross junction of FIG. 7 according to some embodiments of the disclosure.
Figure 9:
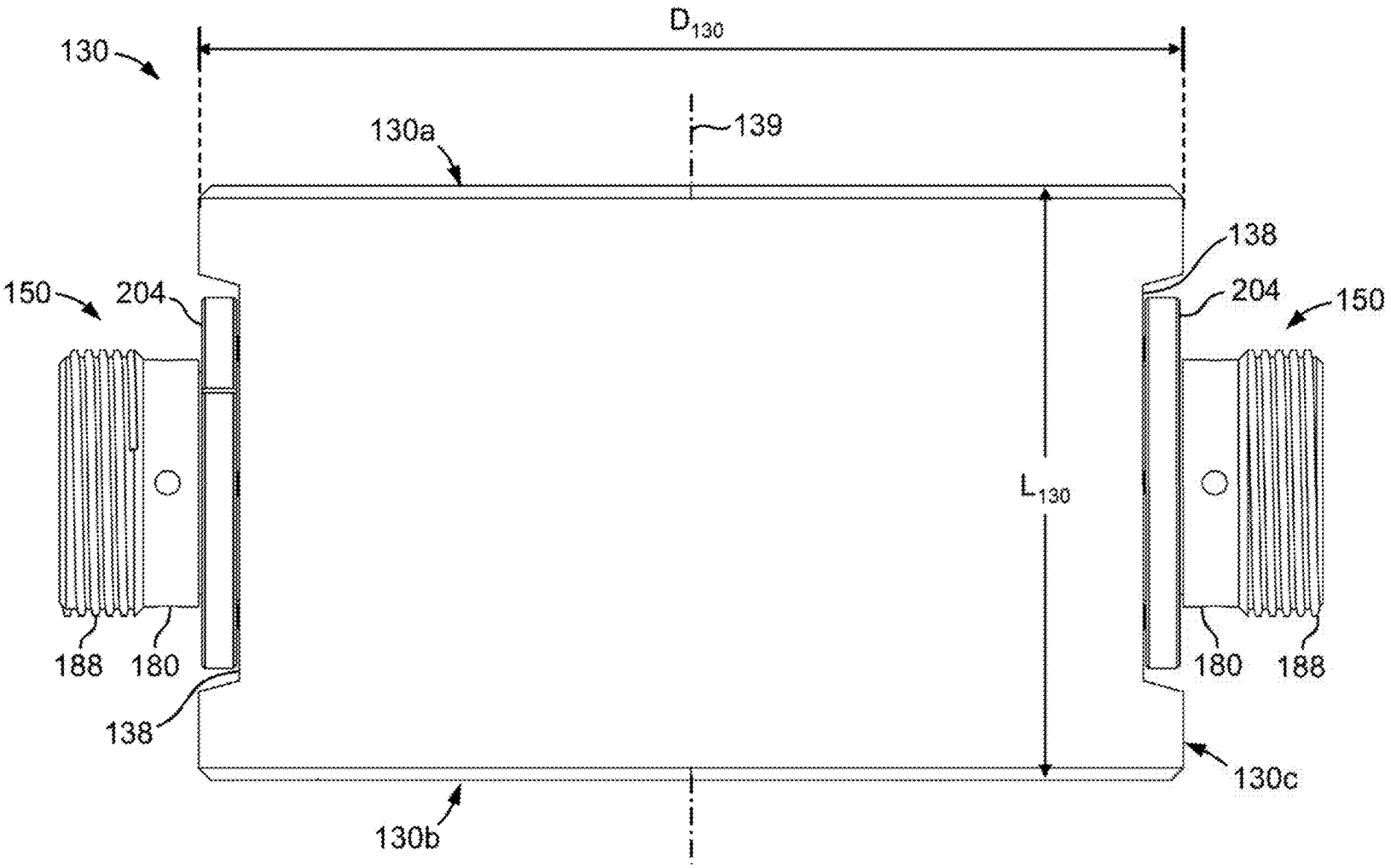
FIG. 9 is a bottom view of the flow cross junction of FIG. 7 according to some embodiments of the disclosure.
Figure 10:
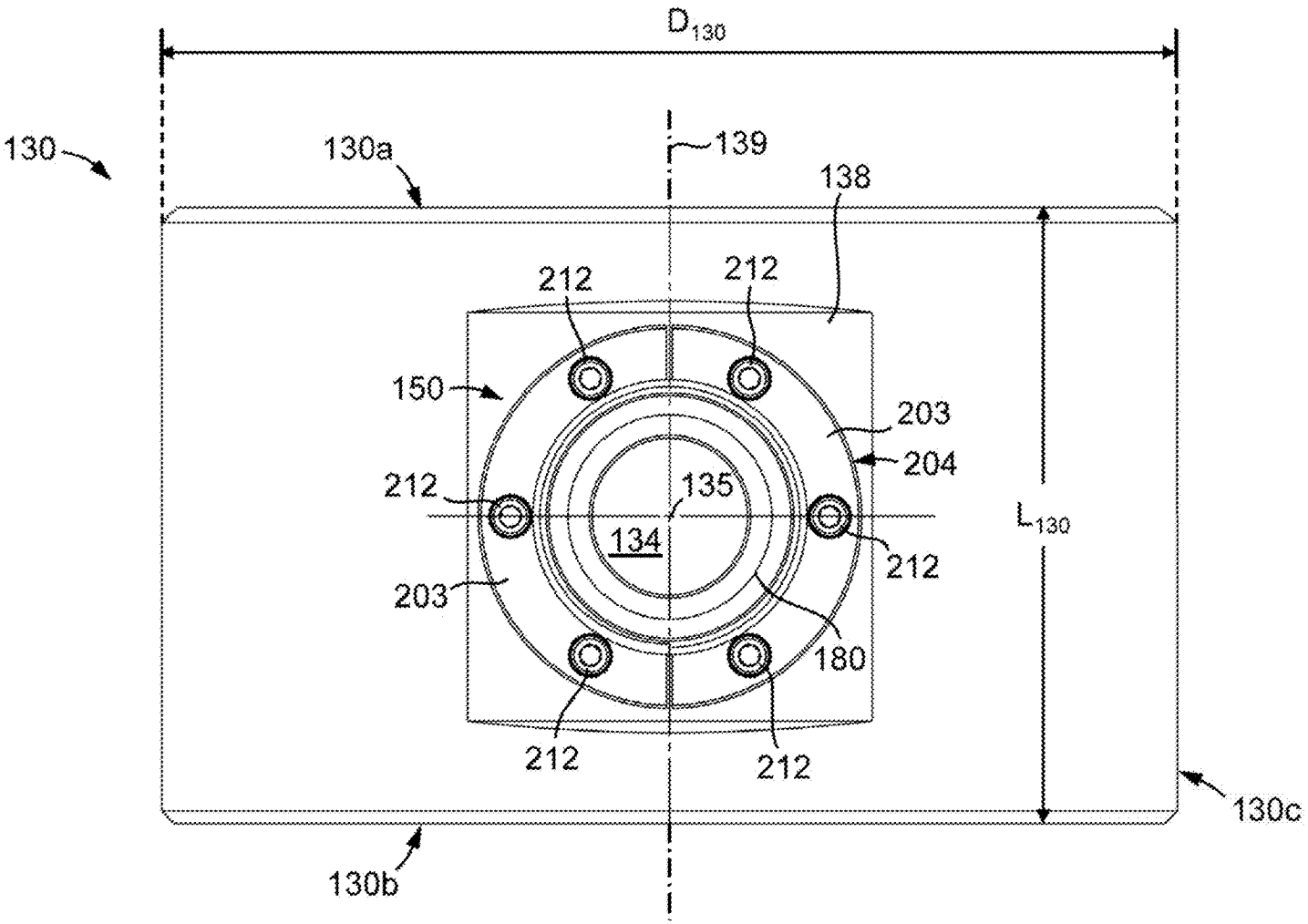
FIG. 10 is a front view of the flow cross junction of FIG. 7 according to some embodiments of the disclosure.
Figure 11:
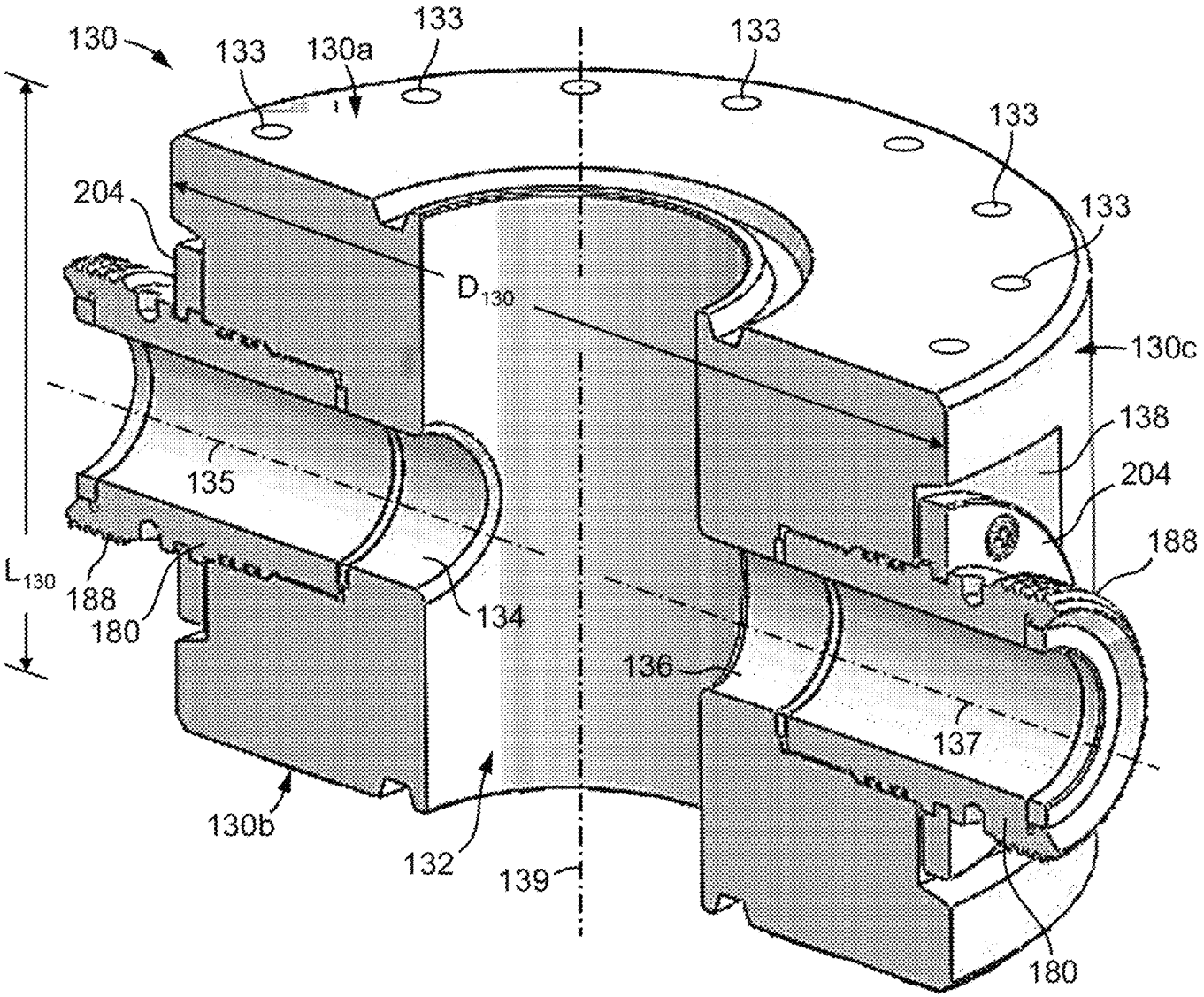
FIG. 11 is a perspective cross-sectional view of the flow cross junction of FIG. 7 taken along section B-B in FIG. 7 according to some embodiments of the disclosure.

In some embodiments, one or more of the flow cross junctions 130 may include a single inlet flow bore (such as inlet flow bore 134 or inlet flow bore 136) or may include more than two inlet flow bores. For instance, FIGS. 5 and 6 illustrate embodiments of the flow cross junction 130 that include more than two inlet flow bores. Specifically, FIG. 5 shows an embodiment of flow cross junction 130 that includes three inlet flow bores 131 in place of the inlet flow bores 134, 136. In addition, FIG. 6 shows an embodiment of flow cross junction 130 that includes four inlet flow bores 131 in place of the inlet flow bores 134, 136.

FIGS. 4 and 7-12 illustrate one of the flow cross junctions 130 of the manifold 100 shown in FIGS. 2 and 3 in greater detail according to some embodiments. The upstream end 130*a* and the downstream end 130*b* each include a plurality of mounting bores 133. The mounting bores 133 each extend axially into the flow cross junction 130 relative to axis 139 from the corresponding end 130*a*, 130*b*. The mounting bores 133 may also be circumferentially spaced (such as evenly circumferentially spaced) about axis 139 along each end 130*a*, 130*b*. The mounting bores 133 may be threaded (and thus may include internal threads) such that each mounting bore 133 may threadably receive a threaded stud 115 (FIG. 4), or other connection member, for connecting ends 130*a*, 130*b* to elongate manifold sections 110 via flanges 114 (FIGS. 2 and 3) as previously described.

In some embodiments, the first inlet flow bore 134 extends along a first axis 135 and the second inlet flow bore 136 extends along a second axis 137. The first axis 135 and the second axis 137 (and thus also the first inlet flow bore 134 and the second inlet flow bore 136, respectively) are radially opposite one another about the axis 139 (and thus also axis 105), and each axis 135, 137 extends radially with respect to axis 139. Thus, the axes 135, 137 are aligned along a common radially extending plane relative to axis 139. In some embodiments, axes 135, 137 may be axially offset from one another along axis 139 such the axes 135, 137 lie in different radially extending planes relative to axis 139. In addition, in some embodiments, one or both of the axes 135, 137 may not extend radially relative to axis 139. For instance, one or both of the axes 135, 137 (and thus also the inlet flow bores 134, 136, respectively) may extend at an angle (such as at an acute angle) relative to the axis 139. In addition, in some embodiments, one or both of the inlet flow bores 134, 136 may be curved.

In some embodiments, the outer surface 130*c* is a cylindrical surface that extends axially between the ends 130*a*, 130*b* relative to axis 139. However, other shapes are contemplated for outer surface 130*c* in other embodiments. For instance, in some embodiments, the outer surface 130*c* may include a polygonal cross-section (such as pentagonal, hexagonal, octagonal, etc.) along a plane passing radially through the central axis 139 so that the radially outer surface 130*c* may be a polygonal surface. The outer surface 130*c* may include one or more (such as one or a plurality of) flats or facets 138 formed therein. As will be described in more detail below, the facets 138 may form flat surface areas along the otherwise curved, cylindrical outer surface 130*c* that may be used to form or machine one or more inlet flow bores (such as, inlet flow bores 134, 136) and/or to provide engagement surfaces for lifting or supporting the flow cross junction 130 during operations. Because the outer surface 130*c* may be a cylindrical surface in some embodiments, the facets 138 may form or define radially inwardly extending recesses in the outer surface 130*c*.

The flow cross junction 130 may include a total axial length $L_{130}$ that is measured axially (with respect to the axis 139) from the upstream end 130*a* to the downstream end 130*b*. In addition, the outer surface 130*c* may have an outer diameter (such as a maximum outer diameter) $D_{130}$ that extends radially across the flow cross junction 130 with respect to the axis 139. In some embodiments, the outer diameter $D_{130}$ may be greater than the axial length $L_{130}$. For instance, in some embodiments, the ratio of the axial length $L_{130}$ to the outer diameter $D_{130}$ ($L_{130}/D_{130}$) may be less than 1.

In some embodiments, one or more parameters or dimensions of the flow cross junction 130 may be selected to minimize a total size and weight of the flow cross junction 130 while still maintaining a sufficient amount of material to contain the high pressures associated with a hydraulic fracturing operation (or other fluid delivery operation as described herein). For instance, in some embodiments, parameters such as the outer diameter $D_{130}$ and the number of mounting bores 133 may selected to comply with specifications set by trade associations such as, for instance, the American Petroleum Institute (API). In some embodiments, the outer diameter $D_{130}$ and number of mounting bores 133 (among other parameters) may be selected to comply with API 6A specification for wellhead and tree equipment (see, for instance, Tables E.5 of API specification 6A including specifications for flanges to withstand 15,000 psi pressure).

As best shown in FIG. 4, in some embodiments, the flanges 114 of the elongate manifold members 110 may also be sized per the same specifications as the parameters of the flow cross junction 130 (e.g., such as API specification 6A as noted above). As a result, an outer diameter $D_{114}$ of the flanges 114 may be the same (or substantially the same) as the outer diameter $D_{130}$ of flow cross junction 130. Accordingly, the cylindrical radially outer surface 130*c* of the flow cross junction 130 may be flush (or co-planar) with a radially outer, cylindrical surface 117 of the flanges 114.

Figure 12:
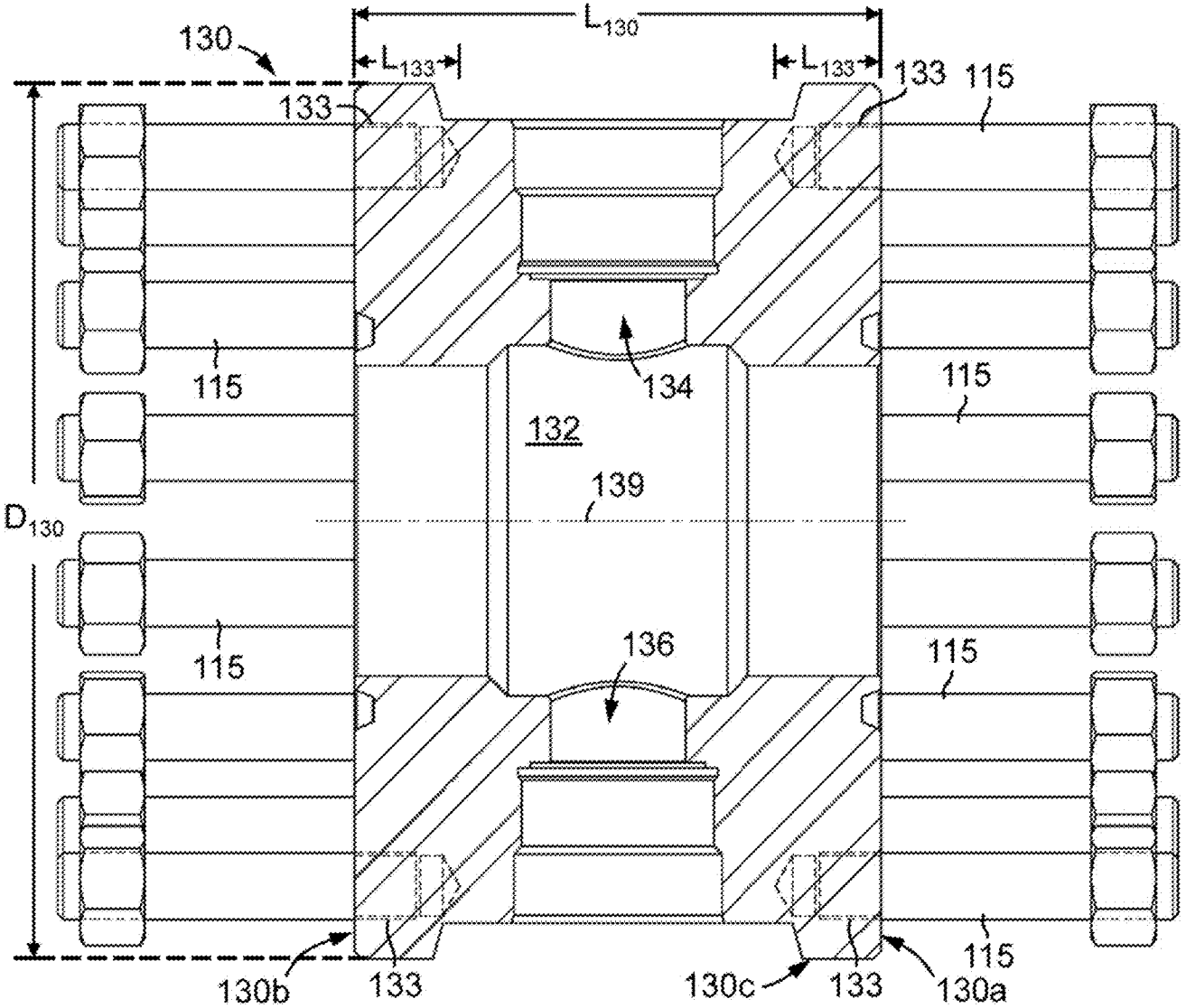
FIG. 12 is a side cross-sectional view of the flow cross junction of FIG. 7 taken along section B-B in FIG. 7 and illustrating the positions of mounting bores and threaded studs relative to the internal flow bores of the flow cross junction according to some embodiments of the disclosure.

As best shown in FIG. 12, in some embodiments, the length $L_{130}$ of the flow cross junction 130 may be selected to provide a minimum wall thickness (in the axial direction with respect to axis 139) about the inlet flow bores 134, 136 and to accommodate the mounting bores 133 for the threaded studs 115. For instance, in some embodiments, the mounting bores 133 may extend a minimum axial length $L_{133}$ into the flow cross junction 130 from the ends 130*a*, 130*b*. The minimum axial length $L_{133}$ may be selected to ensure sufficient threaded engagement between the studs 115 and mounting bores 133 to compress the flanges 114 of elongate manifold sections 110 into the ends 130*a*, 130*b* to thereby form fluid-tight connections therebetween (FIG. 4). In some embodiments, the minimum axial length $L_{133}$ may be in a range from about 1.500 inches (in) to about 1.625 in. The minimum wall thickness about the inlet flow bores 134, 136 may be determined based on a stress analysis of the flow cross junction 130 at the expected fluid pressures (such as at about 9,000 psi or higher as previously described). Thus, the total axial length $L_{130}$ of the flow cross junction 130 may be selected in some embodiments to provide the minimum axial length $L_{133}$ for the mounting bores 133 and the minimum wall thickness about the inlet flow bores 134, 136.

As shown in FIGS. 4 and 7-13, a plurality of fluid coupling assemblies 150 are connected to each flow cross junction 130. For instance, a fluid coupling assembly 150 is connected to each of the inlet flow bores 134, 136 to provide a connection for a conduit connected to an output of pump of the hydraulic fracturing system 10 (FIG. 1). Each fluid coupling assembly 150 includes a coupling adapter 180 that is removably inserted within and extended outward from a corresponding one of the inlet flow bores 134, 136. Further details of embodiments of the inlet flow bores 134, 136 and coupling adapter 180 are provided below according to some embodiments.

Figure 14:
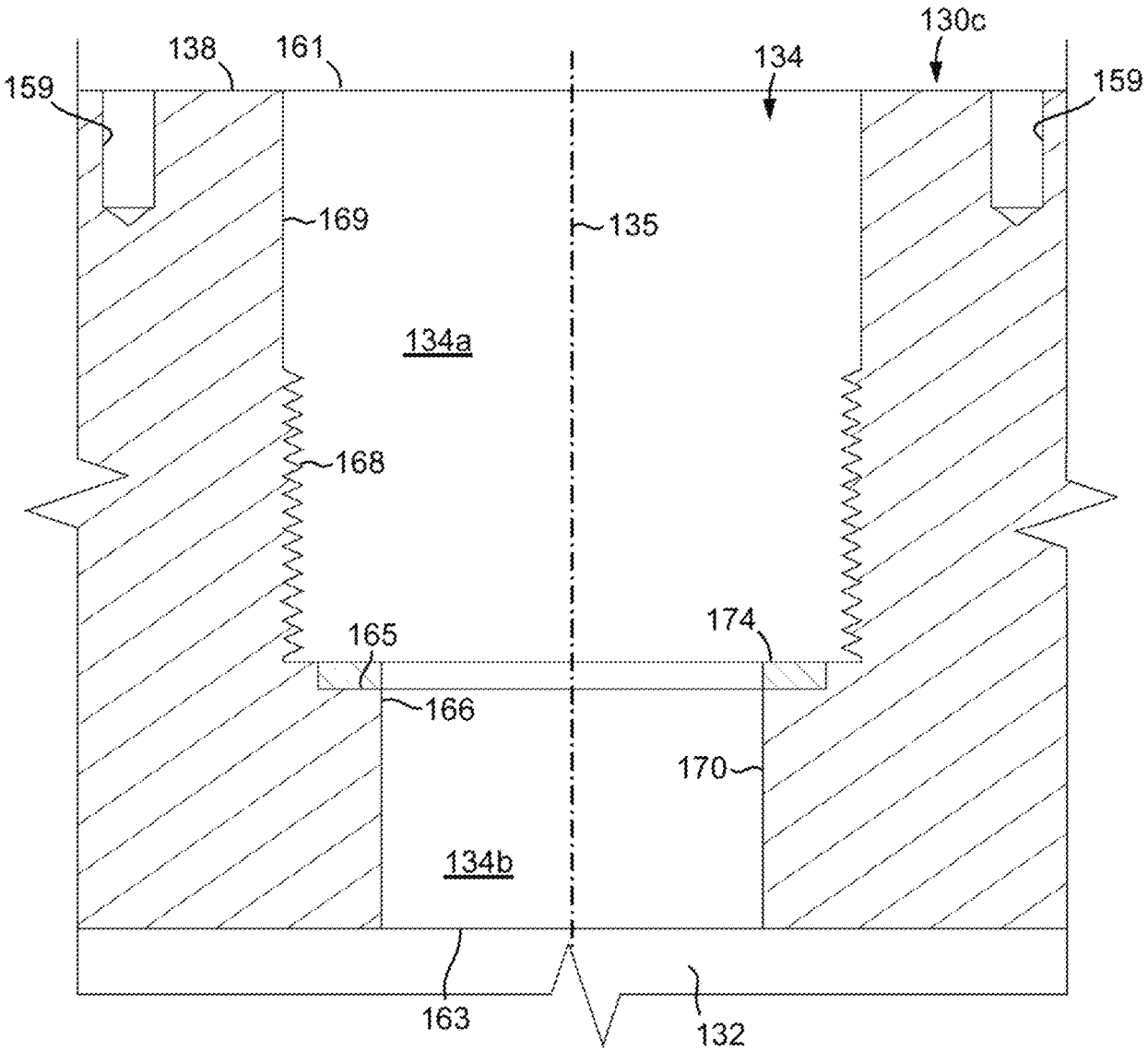
FIG. 14 is an enlarged cross-sectional view of one of the inlet flow bores of the flow cross junction of FIG. 5 according to some embodiments of the disclosure.

FIG. 14 shows the first inlet flow bore 134 of flow cross junction 130 according to some embodiments. It should be appreciated that, in some embodiments, the second inlet flow bore 136 may be configured the same as the first inlet flow bore 134 shown in FIG. 14 such that the following description of embodiments of the first inlet flow bore 134 may be applied to describe embodiments of the second inlet flow bore 136. Thus, the features of first inlet flow bore 134 described herein and shown in the drawings (such as FIG. 14) may also be included within the second inlet flow bore 136 in some embodiments.

First inlet flow bore 134 has a first or outer opening 161 positioned at or along the outer surface 130*c* (particularly along the corresponding one of the facets 138) and a second or inner opening 163 positioned at the intersection between the first inlet flow bore 134 and the main flow bore 132 (FIG. 4). An internal shoulder 166 is formed within the first inlet flow bore 134. The internal shoulder 166 extends radially inward toward the central axis 155 and circumferentially about the central axis 135 within the first inlet flow bore 134. The internal shoulder 166 separates the first inlet flow bore 134 into a first or outer portion 134*a* extending axially from the outer opening 161 to the internal shoulder 166 and a second or inner portion 134*b* extending axially from the internal shoulder 166 to the inner opening 163.

The outer portion 134*a* of first inlet flow bore 134 includes a cylindrical surface 169 extending axially from outer opening 161 along axis 135 and internal threads 168 positioned axially between the cylindrical surface 169 and the internal shoulder 166. Internal threads 168 may include one or more grooves that extend radially into first inlet flow bore 134 and helically about the central axis 135.

A radially extending circumferential ledge or seat 165 is formed on the internal shoulder 166 within the outer portion 164*a*. A gasket 174 (or junk ring) may be positioned on the seat 165 that may sealingly engage both the internal shoulder 166 and the coupling adapter 180 (FIGS. 4 and 13) to prevent or at least restrict the leakage of fracturing fluid out of flow cross junction 130, between the coupling adapter 180 and the inlet flow bore 134 during operations.

Inner portion 134*b* includes a cylindrical surface 170 extending axially from internal shoulder 166 to the inner opening 163. In some embodiments, the cylindrical surface 170 and inner opening 163 may have an inner diameter that is the same as a minimum inner diameter of the internal shoulder 166. As a result, the cylindrical surface 170 may be flush and continuous with a radially inner surface of the internal shoulder 166. In some embodiments, the inner portion 134*b* may have a surface (such as a cylindrical surface) that has an inner diameter that is greater than or less than a minimum inner diameter of the internal shoulder 166. Thus, in some embodiments, the inner portion 134*b* may have one or more surfaces that have a variable (such as increasing or decreasing) inner diameter, such as a frustoconical surface (or chamfer), a curved surface, etc.

The facet 138 along outer surface 130*c* that is associated with the fluid coupling assembly 150 may be a planar surface that extends radially relative to central axis 135 and circumferentially about the outer opening 161 of first inlet flow bore 134. A plurality of mounting bores 159 extend axially into the flow cross junction 130 from the facet 138 and may be arranged about the outer opening 161. The mounting bores 159 may be threaded (at least partially) such that they may receive one or more threaded mounting members (such as, mounting members 212 described herein) during operations. In some embodiments, mounting bores 159 may be evenly circumferentially spaced about axis 155 along the corresponding facet 138.

Figure 13:
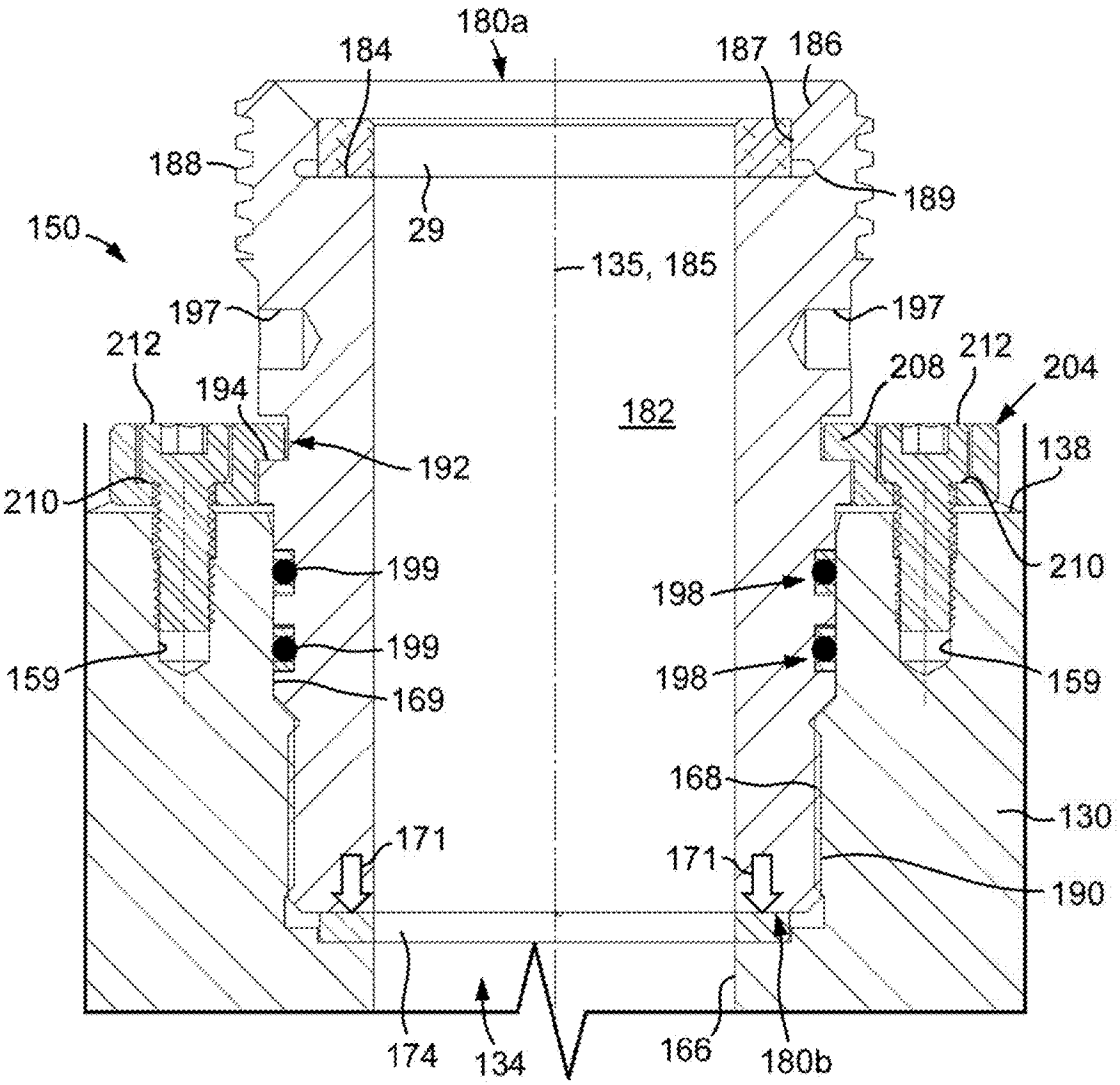
FIG. 13 is an enlarged cross-sectional view of one of the fluid coupling assemblies of the flow cross junction of FIG. 5 according to some embodiments of the disclosure.
Figure 15:
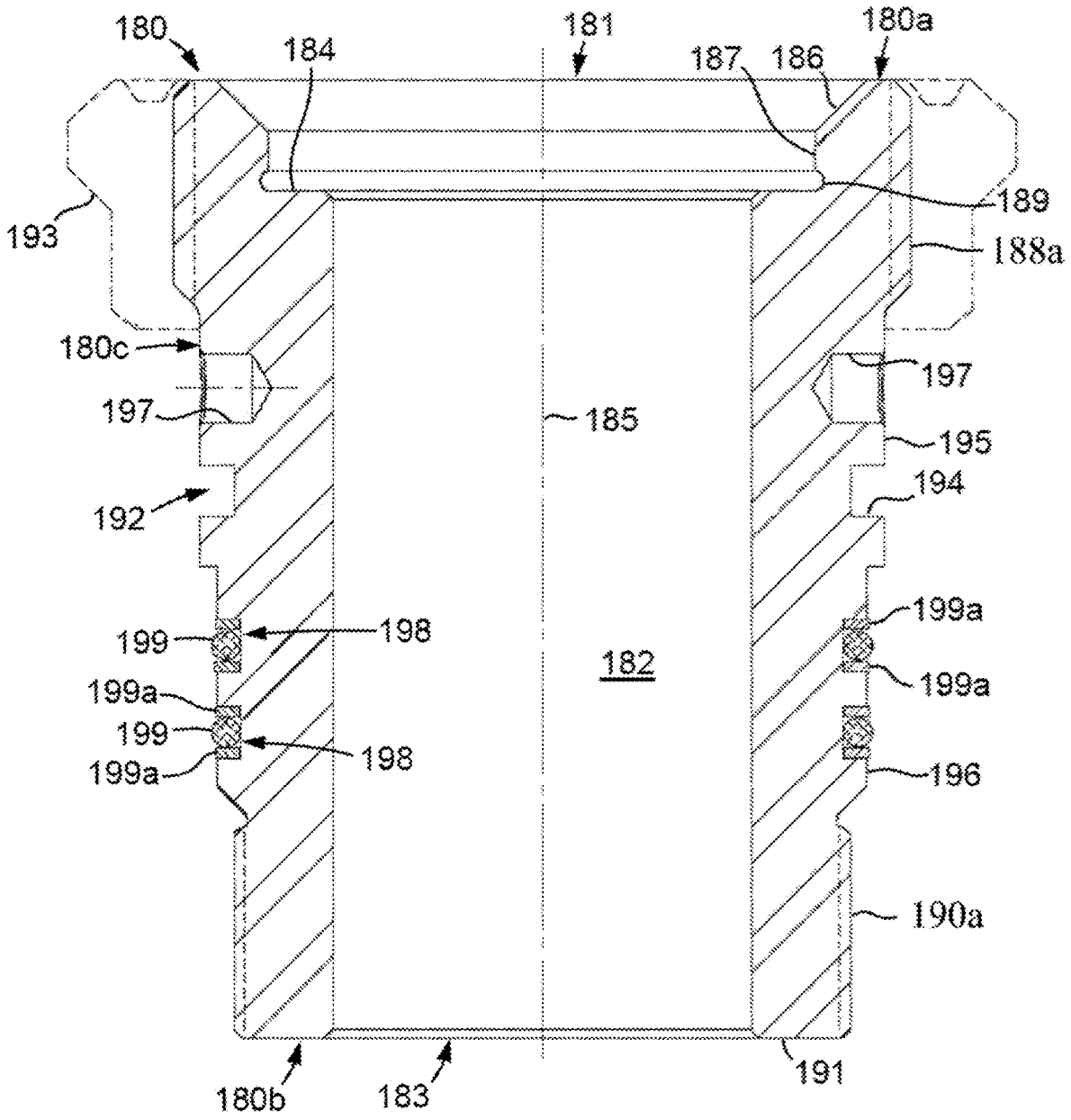
FIG. 15 is a cross-sectional view of the coupling adapter of the fluid coupling assembly of FIG. 13 according to some embodiments of the disclosure.

FIG. 15 shows the coupling adapter 180 of one of the fluid coupling assemblies 150 according to some embodiments. According to some embodiments, coupling adapter 180 may be an elongate tubular member that includes a central axis 185, a first end 180*a*, and a second end 180*b* opposite the first end 180*a*. As shown in FIG. 13, the second end 180*b* may be inserted within the first inlet flow bore 134 (or the second inlet flow bore 136) such that the first end 180*a* is extended outward from the first inlet flow bore 134 when coupling adapter 180 is connected to the flow cross junction 130. Thus, first end 180*a* may be referred to herein as the outer end 180*a* and the second end 180*b* may be referred to as the inner end 180*b* of the coupling adapter 180. As shown in FIG. 15, coupling adapter 180 also includes a throughbore 182 and a radially outer surface 180*c*, each extending generally axially between ends 180*a*, 180*b* relative to axis 139.

Throughbore 182 extends axially through the coupling adapter 180 along central axis 185 from the outer end 180*a* to the inner end 180*b*. Thus, the throughbore 182 has a first or outer opening 181 positioned at the outer end 180*a* and a second or inner opening 183 positioned at the inner end 180*b*. An internal shoulder 184 is defined within the throughbore 182. In some embodiments, the internal shoulder 184 may be positioned axially closer (and more proximate) to the outer end 180*a* and outer opening 181 than the inner end 180*b* and inner opening 183. The internal shoulder 184 extends radially inward toward the central axis 185 within throughbore 182.

In addition, throughbore 182 may include a tapered or frustoconical surface 186 (or "chamfer") that extends from outer end 180*a* and outer opening 181 and a cylindrical surface 187 extending axially from frustoconical surface 186 to shoulder 184. The frustoconical surface 186 tapers radially inward toward central axis 185 when moving axially from outer end 180*a* and outer opening 181 toward cylindrical surface 187. Thus, the inner diameter of throughbore 182 may decrease when moving axially from outer end 180*a* and outer opening 181 toward cylindrical surface 187.

A circumferential or annular groove 189 is positioned along cylindrical surface 187. The annular groove 189 extends both radially into cylindrical surface 187 (and thus radially away from central axis 185) and circumferentially about the central axis 185. In some embodiments (such as the embodiment shown in FIG. 15), the annular groove 189 is positioned on the cylindrical surface 187 at the intersection with internal shoulder 184; however, in some embodiments the annular groove 189 may be axially spaced from the internal shoulder 184 along cylindrical surface 187. The annular groove 189 may be configured to receive an annular sealing member (e.g., an O-ring, seal ring, etc.) therein (such as at least partially therein).

As illustrated by FIG. 4, during operations, a coupling 27 connected to a corresponding one of the outlet conduits 26 shown in FIG. 1 may be inserted into the throughbore 182 from outer opening 181. During this process, the frustoconical surface 186 may guide and center the coupling 27 within the throughbore 182, and the coupling 27 may be compressed into the shoulder 184. An annular seal member 29 positioned on shoulder 184 may sealingly engage with an outer surface of the coupling to prevent or at least restrict leakage of fracturing fluid out of the throughbore 182. As will be described in more detail below, a connector 193 connected to the coupling 27 may engage with coupling adapter 180 to secure the coupling 27 to the coupling adapter 180 during operations.

Figure 16:
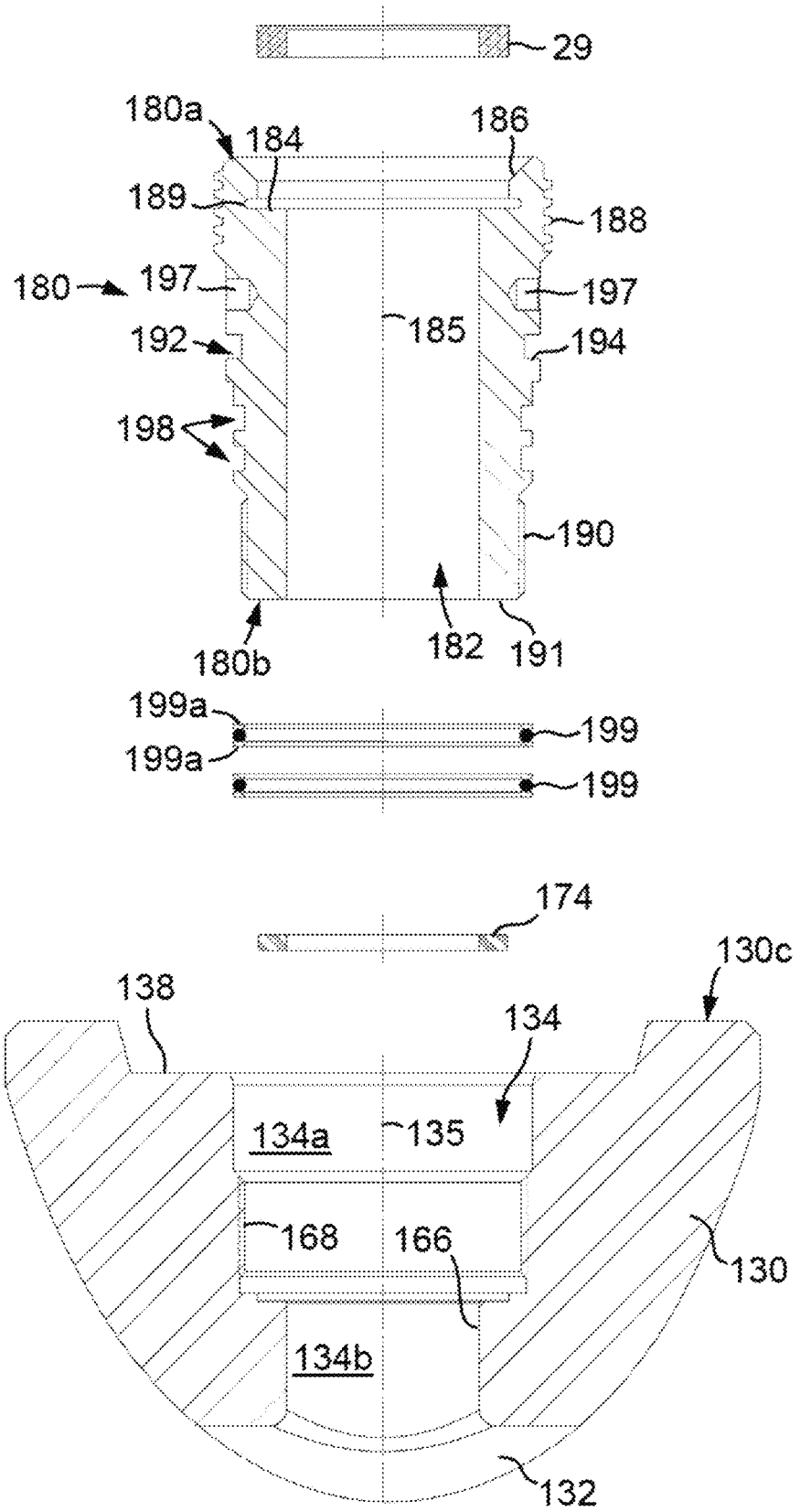
FIG. 16 is an exploded, cross-sectional view of the fluid coupling assembly of FIG. 13 according to some embodiments of the disclosure.

As shown in FIGS. 13, 15, and 16, an inner end face 191 is defined and positioned on the inner end 180*b*. The inner end face 191 may be a planar surface that extends radially relative to central axis 185 and circumferentially about the inner opening 183 of throughbore 182.

As shown in FIG. 15, radially outer surface 180*c* includes a first connection device 188*a* and a second connection device 190*a*. The first connection device 188*a* and second connection device 190*a* may be any suitable connection feature (such as threads, clamps, etc.). In some embodiments (such as the embodiment shown in FIG. 15), the first connection device 188 includes a first set of external threads 188 and the second connection device 190*a* includes a second set of external threads 190.

The first set of external threads 188 may be more simply referred to herein as "first threads" 188 and the second set of external threads 190 may be more simply referred to herein as "second threads" 190. The first threads 188 and the second threads 190 may be separate and axially spaced from one another along radially outer surface 180*c*. In addition, the first threads 188 may be positioned axially closer (and more proximate) to outer end 180*a* than inner end 180*b*, and second threads 190 may be positioned more proximate to inner end 180*b* than outer end 180*a*. For instance, in some embodiments, the first threads 188 are positioned at (and extend axially from) the outer end 180*a* and the second threads 190 are positioned at (and extend axially from) the inner end 180*b*. The first threads 188 and the second threads 190 may include one or more grooves that extend radially into radially outer surface 180*c* and helically about the central axis 185.

An annular groove or recess 192 is axially positioned between the first threads 188 and the second threads 190. The recess 192 extends radially into the radially outer surface 180*c* toward central axis 185 and defines a radially extending annular external shoulder 194 that faces axially toward the outer end 180*a*. The annular external shoulder 194 may be more simply referred to herein as an "external shoulder" 194.

A first or outer cylindrical surface 195 extends axially between first threads 188 and annular recess 192, and a second or inner cylindrical surface 196 extends axially between external shoulder 194 and second threads 190. A plurality of engagement bores 197 extend radially into the outer cylindrical surface 195. In some embodiments, the engagement bores 197 are evenly circumferentially spaced about central axis 185 along outer cylindrical surface 195. As will be described in more detail below, engagement bores 197 may engage with a suitable tool (such as a spanner wrench) to facilitate threaded engagement or disengagement of the coupling adapter 180 from one of the inlet flow bores 134, 136 (FIG. 13) during operations.

As shown in FIG. 15, one or more annular seal grooves or recesses 198 are positioned along the inner cylindrical surface 196. The recesses 198 may be axially spaced from one another along inner cylindrical surface 196 and may each be configured to receive an annular seal member 199 (which may include an elastomer seal member such as an O-ring) therein. In some embodiments, each annular seal member 199 may be axially compressed between a pair of seal rings 199*a* within the corresponding recess 198. As will be described in more detail below, when coupling adapter 180 is inserted within one of the inlet flow bores 134, 136 (FIG. 13), the annular seal members 199 positioned in recesses 198 may sealingly engage the inlet flow bore 134, 136 to prevent or at least restrict the leakage of fracturing fluid from through-passage 164 and coupling adapter 180 during operations.

As illustrated by FIGS. 4, 5, and 13, as previously noted, the coupling adapter 180 may represent the component of the fluid coupling assembly 150 having the highest likelihood of failure during a hydraulic fracturing operation. Thus, the coupling adapters 180 of fluid couplings 150 may be selectively installed or uninstalled from the inlet flow bores 134, 136 during operations. As a result, in the event of a failure of a coupling adapter 180 (such as at the first threads 188), the failed coupling adapter 180 may be readily and quickly removed and replaced without disturbing a flanged connection of the manifold 100 (or other more substantial coupling assembly or mechanism). Accordingly, by separately providing a coupling adapter 180 that is removably inserted within one of the inlet flow bores 134, 136 of flow cross junction 130, personnel may perform a much simpler and safer operation of disconnecting, removing, and replacing the coupling adapter 180 without disconnecting other more bulky connection mechanisms (or flanged connections).

When installing the coupling adapter 180 into the inlet flow bores 134, 136 of flow cross junction 130, the inner end 180*b* of coupling adapter 180 is inserted through outer opening 161 such that second threads 190 are threadably engaged with the interior threads 168 within the inlet flow bores 134, 136. More particularly, FIGS. 13 and 16 illustrate the coupling adapter 180 installed within the first inlet flow bore 134 (it being understood that a coupling adapter 180 may be installed within the inlet flow bore 136 in the same manner). As may be appreciated from FIGS. 13 and 16, the inner end 180*b* of coupling adapter 180 is inserted into outer portion 134*a* of first inlet flow bore 134 until second treads 190 abut or engage with inner threads 168. Thereafter, the coupling adapter 180 is rotated about axis 185 so that second threads 190 threadably engage with interior threads 168 to force coupling adapter 180 axially into inlet flow bore 134 from outer opening 161 along the central axes 135, 185. Threaded engagement of threads 190, 168 continues until inner end face 191 on inner end 180*b* is engaged with and urged into gasket 174 such that gasket 174 is axially compressed relative to axes 135, 185 between the inner end face 191 (and inner end 180*b*) and internal shoulder 166, and such that coupling adapter 180 is axially compressed relative to axes 135, 185 against internal shoulder 166 via gasket 174 along arrows 171 in FIG. 13. As previously described, the compression of gasket 174 between inner end face 191 and shoulder 166 (specifically seat 165) may create a fluid-tight seal that prevents or restricts fracturing fluid from leaking out of inlet flow bore 134 or throughbore 182 radially between coupling adapter 180 and outer portion 134*a* of inlet flow bore 134. During insertion of coupling adapter 180 within outer portion 134*a* of inlet flow bore 134, a suitable tool such as a spanner wrench may be engaged with the engagement bores 197 on coupling adapter 180 to impart torque to the coupling adapter 180 about the aligned axes 135, 185.

Figure 17:
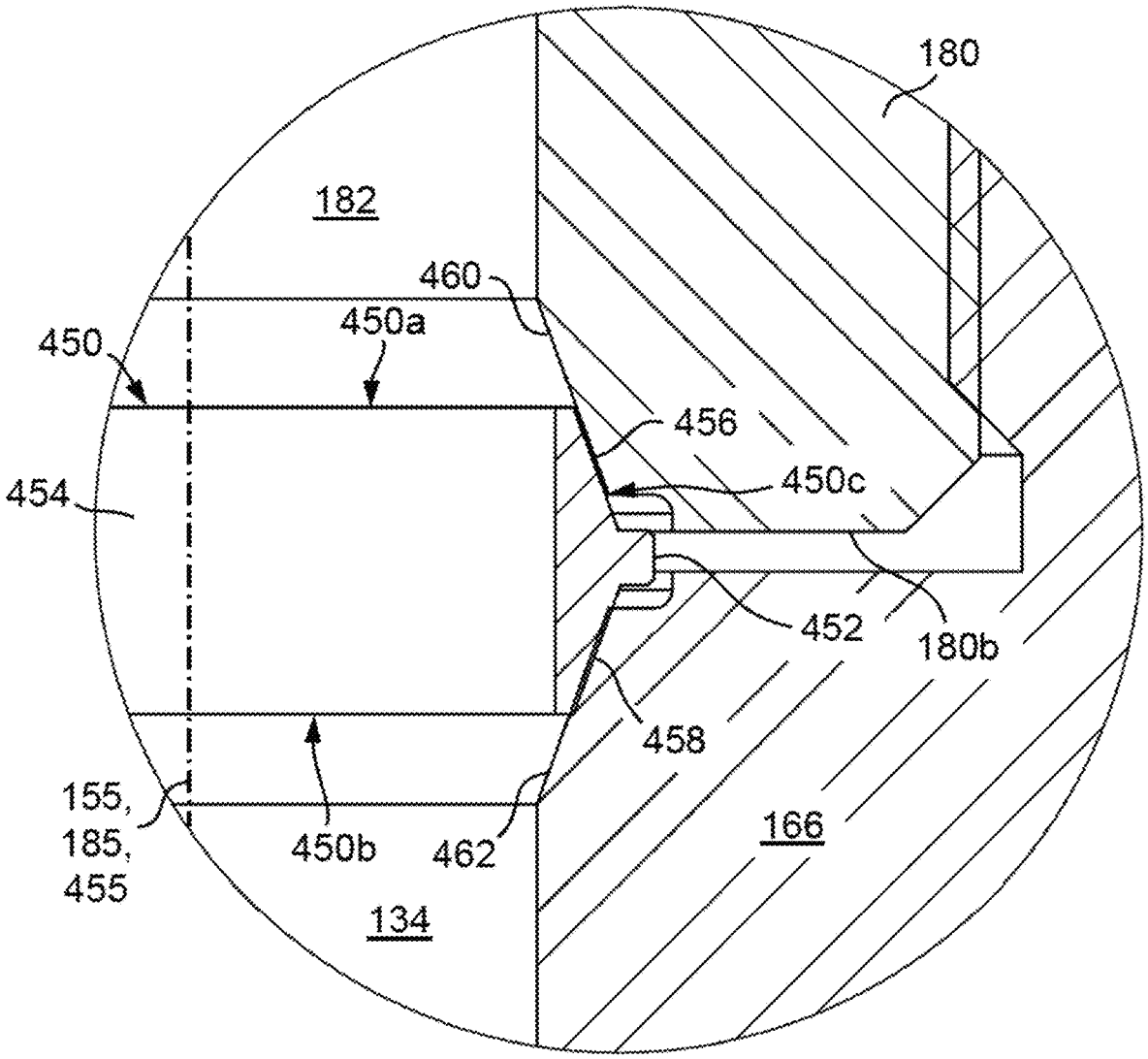
FIG. 17 is an enlarged cross-sectional view of a metallic seal junk ring of the fluid coupling assembly of FIG. 13 according to some embodiments of the disclosure.

As shown in FIG. 17, in some embodiments, the junk ring 174 may comprise a metallic gasket that is axially captured and compressed between the coupling adapter 180 (particularly inner end 180*b*) and shoulder 166. As shown in FIG. 17, the junk ring 174 when configured as a metallic gasket or seal may include a central axis 455, a first end 450*a*, a second end 450*b* opposite the first end 450*a*, a throughbore 454 extending between ends 450*a*, 450*b*, and a radially outer surface 450*c* also extending between ends 450*a*, 450*b*. The radially outer surface 450*c* may include a radially extending, annular projection 452 that is positioned axially between ends 450*a*, 450*b* along axis 455. In addition, radially outer surface 450*c* may include a first frustoconical surface 456 extending from the first end 450*a* to the projection 452 and a second frustoconical surface 458 extending from the projection to the second end 450*b*. The first frustoconical surface 456 may diverge radially away from the axis 455 when moving axially from the first end 450*a* toward the projection 452, and the second frustoconical surface 458 may diverge radially away from the axis 455 when moving axially from the second end 450*b* to the projection 452. When the metallic junk ring 174 is installed within the inlet flow bore 134 (or the inlet flow bore 136) and compressed between the shoulder 166 and inner end 180*b* of coupling adapter 180, the central axis 455 of junk ring 450 may be generally aligned with the axes 135 (or axis 137), 185.

When the metallic seal junk ring 174 is compressed between the coupling adapter 180 and the shoulder 166, the first frustoconical surface 456 may be engaged with a corresponding and complimentary frustoconical surface (or chamfer) 460 formed within the throughbore 182 of coupling adapter 180, and the second frustoconical surface 458 may be engaged with a corresponding and complimentary frustoconical surface (or chamfer) 462 formed on the shoulder 166. Thus, as may be appreciated in FIG. 17, as the coupling adapter 180 is threadably advanced into the inlet flow bore 134 (or the inlet flow bore 136), the engagement between the frustoconical surfaces 456, 458, 460, 462 may impart a radially inward pressure onto the junk ring 174, and the projection 452 may be axially compressed between the coupling adapter 180 and shoulder 166 (or between seats formed thereon). The radially inward pressure imparted to the junk ring 174 via the engagement of frustoconical surface 456, 458, 460, 462 may be directed normally through the engaged surfaces 452, 460 and normally through the engaged surfaces 454, 462. Thus, the engagement between the frustoconical surfaces 456, 458, 460, 462 and potentially the engagement between coupling adapter 180, shoulder 166 and projection 452 may form a fluid-tight seal between the seal ring 174 that prevents (or at least restricts) the leakage of fracturing fluid out of the through-passage 164 and along the outer surface 180*c* of coupling adapter 180.

Thus, by threadably engaging the coupling adapter 180 within the first inlet flow bore 134 (or the second inlet flow bore 136), the coupling adapter 180 is axially compressed into the inlet flow bore 134 and against the internal shoulder 166 along the aligned axes 135, 185 (such as along arrows 171 in FIG. 13). Without being limited to this or any other theory, compressing the coupling adapters 180 axially into the inlet flow bores 134, 136 may counter a pressure of the fracturing fluid that may tend to push the coupling adapters 180 out of the inlet flow bores 134, 136 during operations.

As may be appreciated from FIG. 4, the insertion of the coupling adapter 180 within the inlet flow bore 134 may position the outer end 180*a*, the first threads 188, the engagement bores 197, the annular recess 192, and external shoulder 194 of coupling adapter 180 outside of the inlet flow bore 134 at the outer openings 161. Thus, the first threads 188 are accessible to allow connection to an output of one of the outlet conduits 26 as previously described. For instance, as previously described, a connector 193 (such as a threaded connector, a hammer union, a flanged connector, a clamp, a hub, a swivel, a weld component, etc.) of the coupling 27 may be threadably engaged with the first threads 188 to allow coupling adapter 180 to be connected to the coupling 27 (and thus to one of the outlet conduits 26 (FIG. 1)).

In addition, as shown in FIG. 13, when coupling adapter 180 is inserted and engaged within outer portion 134*a* of inlet flow bore 134 (or the inlet flow bore 136), the inner cylindrical surface 196 of coupling adapter 180 is engaged with cylindrical surface 169 within outer portion 134*a*. As a result, the annular sealing members 199 positioned within recesses 198 of coupling adapter 180 may be sealingly engaged between the recesses 198 and cylindrical surface 169 to provide and additional seal to prevent or restrict fracturing fluid from leaking radially between the coupling adapter 180 and the outer portion 134*a* of inlet flow bore 134.

Figure 18:
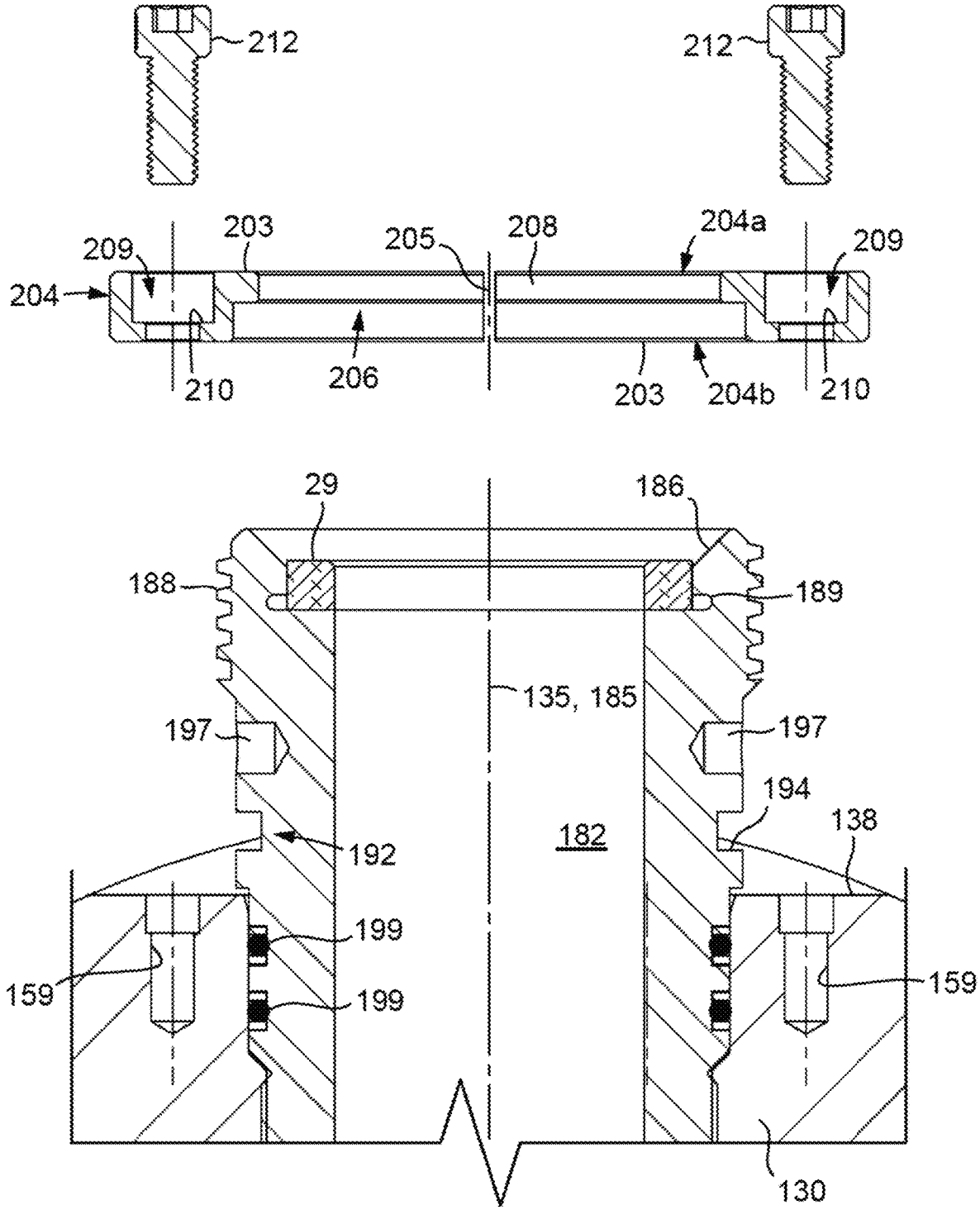
FIG. 18 is partially exploded, cross-sectional view of the fluid coupling assembly of FIG. 13 according to some embodiments of the disclosure.
Figure 19:
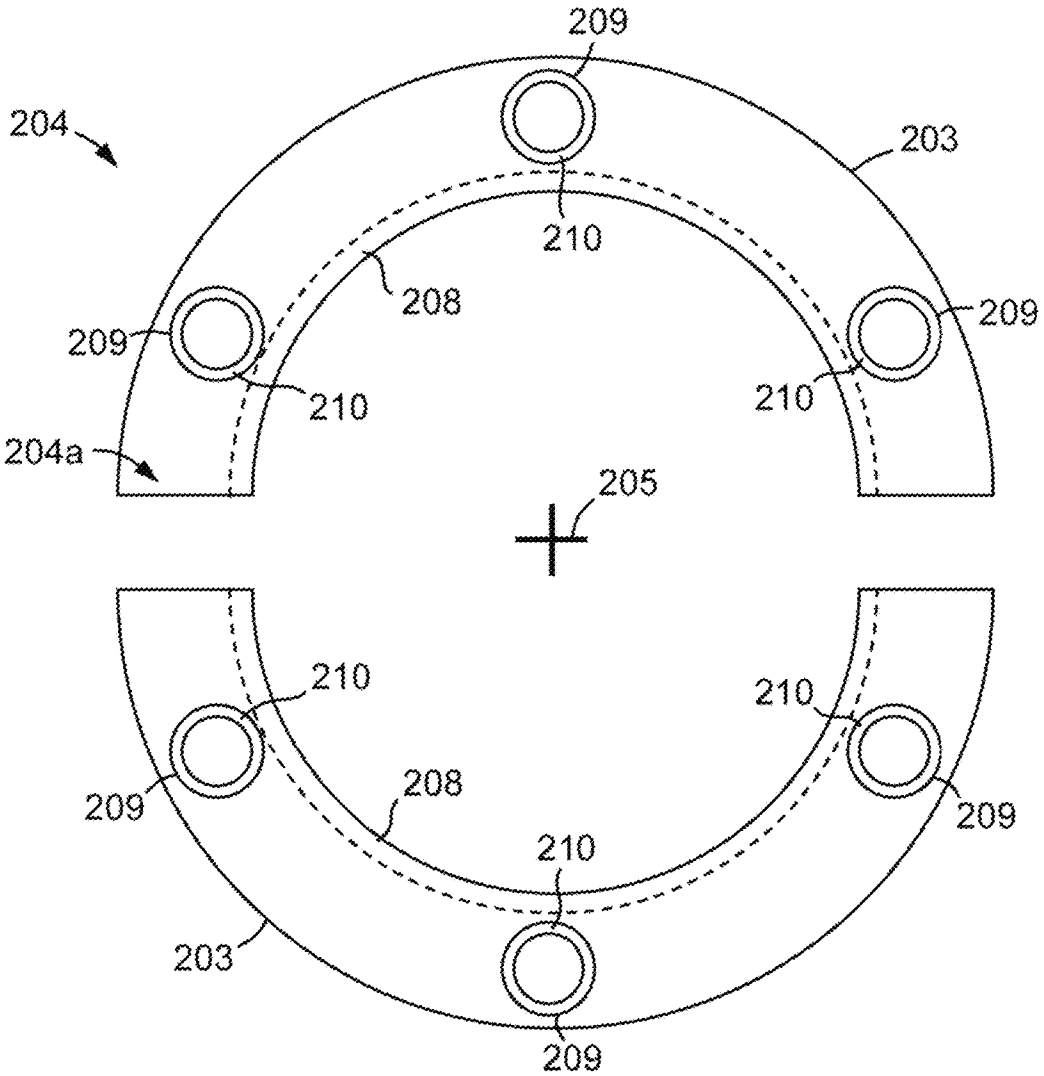
FIG. 19 is a top view of a retainer ring of the coupling assembly of FIG. 13 according to some embodiments of the disclosure.
Figure 20:
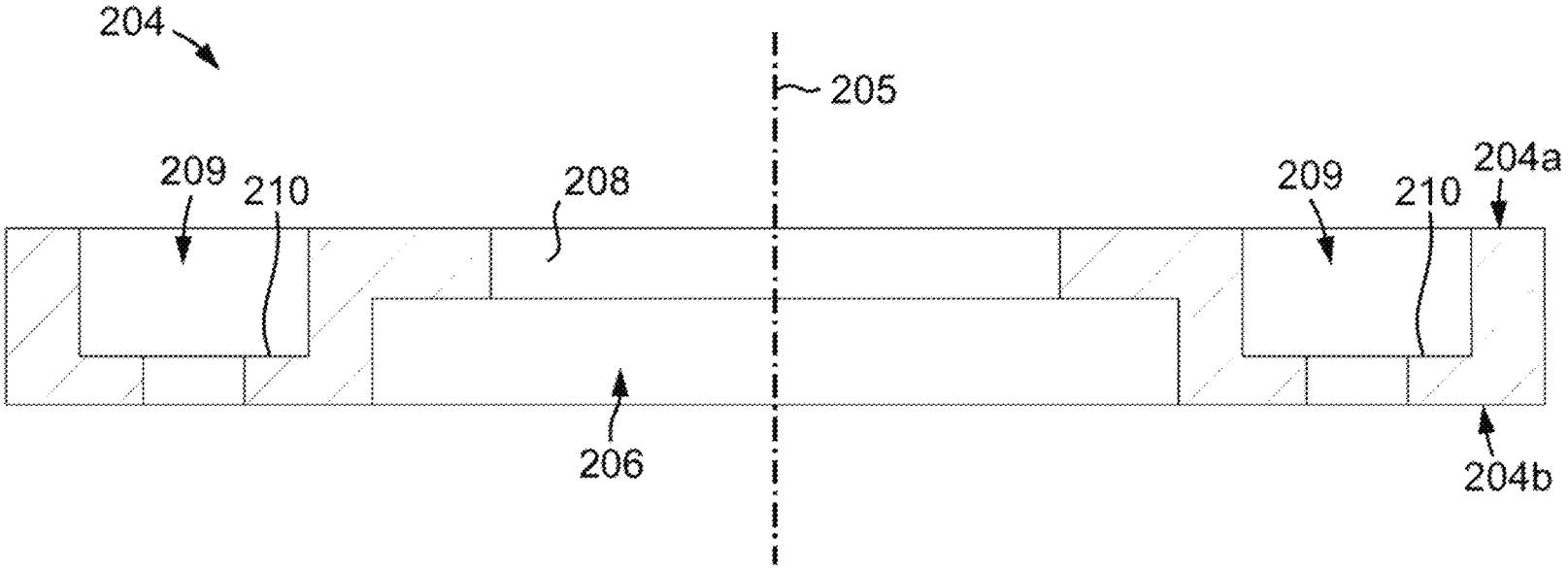
FIG. 20 is a side, cross-sectional view of the retainer ring of FIG. 19 according to some embodiments of the disclosure.

As shown in FIGS. 13 and 18, after coupling adapter 180 is inserted and engaged within outer portion 134*a* of inlet flow bore 134 (or inlet flow bore 136) as described above, a retainer ring 204 may be engaged with external shoulder 194 on radially outer surface 130*c* of flow cross junction 130 to prevent (or restrict) rotation of the coupling adapter 180 within inlet flow bore 134 about axes 135, 185. Specifically, as best shown in FIGS. 18-20, the retainer ring 204 includes a first side 204*a*, a second side 204*b* opposite first side 204*a*, and central opening 206 extending along a central axis 205 between the first side 204*a* and the second side 204*b*. In addition, retainer ring 204 includes an annular projection 208 that extends circumferentially about the central opening 206 about central axis 205. Further, retainer ring 204 includes a plurality of mounting apertures 209 that extend axially between sides 204*a*, 204*b* that are circumferentially spaced about axis 205. In some embodiments, the mounting apertures 209 are uniformly circumferentially spaced about axis 205. As best shown in FIG. 20, each mounting aperture 209 includes a shoulder 210 (such as an annular shoulder).

As shown in FIGS. 18 and 19, retainer ring 204 may be formed of a plurality of ring segments 203 that may be joined together. In some embodiments, the retainer ring 204 includes two ring segments 203, each extending about 180° about the axis 205 when ring segments 203 are joined together to form the retainer ring 204. However, other numbers and arrangements of ring segments 203 are contemplated. For instance, in some embodiments, retainer ring 204 is formed of more than two ring segments 203. In addition, in some embodiments, the ring segments 203 (whether there are two or more than two) may have different arc lengths about axis 205.

As shown in FIGS. 13, 18, and 20, during operations, the ring segments 203 of retainer ring 204 are joined together about the coupling adapter 180 such that the projection 208 is inserted within the recess 192 on radially outer surface 180*c* of coupling adapter 180. A plurality of mounting members 212 (such as threaded screws) may be inserted through the mounting apertures 209 and threadably engaged within the mounting bores 159 formed on facet 138 of radially outer surface 130*c* of flow cross junction 130. The mounting members 212 may engage with the shoulders 210 formed in mounting apertures 209 so that projection 208 is compressed axially into the external shoulder 194 on coupling adapter 180. When retainer ring 204 is connected to flow cross junction 130 so that projection 208 is compressed against external shoulder 194 of coupling adapter 180, the central axis 205 of retainer ring 204 may be aligned with the central axis 185 of coupling adapter 180 and/or the central axis 135 of inlet flow bore 134.

Without being limited to this or any other theory, engaging the retainer ring 204 with the external shoulder 194 of coupling adapter 180 may further secure the coupling adapter 180 within the inlet flow bore 134 or inlet flow bore 136 against the pressure of the fracturing fluid within the outlet manifold 100 during operations as previously described above. In addition, engaging the retainer ring 204 with the external shoulder 194 of coupling adapter 180 may also relieve pressure on the engaged threads 168, 190 during operations. Further, preventing (or restricting) rotation of the coupling adapter 180 about the central axis 185 via the retainer ring 204 may prevent unthreading of the coupling adapter 180 from the outer portion 134*a* of inlet flow bore 134 (or inlet flow bore 136) (via second threads 190 and interior threads 168) during operations (such as when installing or removing the connector 193 from the coupling adapter 180 via first threads 188).

As illustrated by FIGS. 13, 16, and 18, the removal of coupling adapter 180 from inlet flow bore 134 (or inlet flow bore 136) may be accomplished by reversing the sequence described above for installing the coupling adapter 180 into inlet flow bore 134. For instance, the retainer ring 204 may be removed from the base 152 via removal of mounting members 212 from mounting bores 159. Thereafter, the coupling adapter 180 may be unthreaded from inlet flow bore 134 (or inlet flow bore 136) by rotating coupling adapter 180 about central axis 185 within inlet flow bore 134 (such as via a spanner wrench or other suitable tool) to threadably disengage the threads 190, 168. Once second threads 190 on coupling adapter 180 are fully disengaged with internal threads 168, the coupling adapter 180 may be removed from inlet flow bore 134 (and repaired or replaced as appropriate).

As may be appreciated from FIGS. 4-9, because the fluid coupling assemblies 150 (particularly the coupling adapters 180) are directly, threadably engaged within the inlet flow bores 134, 136 (FIG. 4) of flow cross junction 130, additional flanged connections between the fluid couplings 140 and the flow cross junction 130 are avoided. Such a flanged connection would require the formation of large (such as in diameter and depth) threaded mounting bores (such as mounting bores 133 on ends 130*a*, 130*b*) in the radially outer surface 130*c* to receive threaded studs for the flanged connection, which would further necessitate an increase in the length $L_{130}$ relative to the outer diameter $D_{130}$ to ensure a sufficient wall thickness about the flow bores 132, 134, 136. By contrast, embodiments of the flow cross junction 130 described herein avoid these additional flanged connections along radially outer surface 130*c* and instead directly connect the coupling adapters 180 of fluid coupling assemblies 150 into inlet flow bores 134, 136. Moreover, the mounting apertures 159 formed on the facets 138 (or the facets 138 associated with the fluid coupling assemblies 150) for receiving mounting members 212 may be smaller (both in diameter and in depth), fewer in number, and may occupy a smaller portion of the surface area of radially outer surface 130*c* than the mounting bores typically associated with a flanged connection for the fluid coupling assemblies 150. As a result, the use of these smaller mounting bores 159 may avoid an increase of the length $L_{130}$ relative to the outer diameter $D_{130}$ of the flow cross junction 130. Accordingly, by employing the directly connected (such as threaded) fluid coupling assemblies 150, the length $L_{130}$ of the flow cross junction 130 may be substantially reduced relative to the outer diameter $D_{130}$ as previously described while still providing a sufficient wall thickness about each of the flow bores 134, 136, 136 for containing the high-pressure fracturing fluid during operations.

Moreover, this reduction in the length $L_{130}$ relative to the outer diameter $D_{130}$ when combined with the cylindrical (or polygonal) outer surface 130*c* may substantially reduce the size and weight of the flow cross junction 130 and the manifold 100 (FIGS. 2 and 3) overall. This reduction in the size and weight of the manifold 100 may increase both the safety and efficiency of the hydraulic fracturing operation by reducing total footprint of the manifold 100 and avoiding or reducing the reliance on large lifting and support equipment for constriction, deconstruction, and repair of the manifold.

Figure 21:
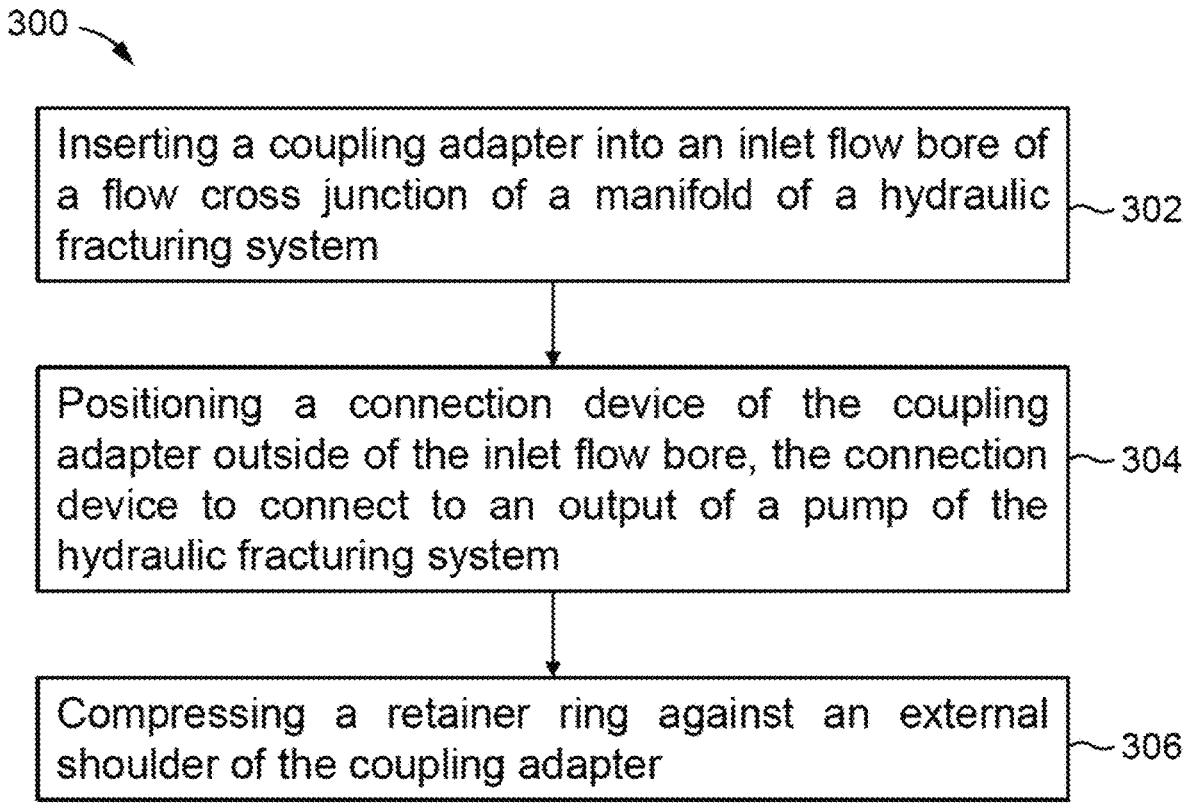
FIG. 21 is a diagram of a method of installing a coupling adapter of a fluid coupling assembly within a flow cross junction of an outlet manifold of a hydraulic fracturing system according to some embodiments of the disclosure.

FIG. 21 shows a method 300 of installing a coupling adapter of a fluid coupling assembly within a flow cross junction of an outlet manifold of a hydraulic fracturing system according to some embodiments. In some embodiments, the method 300 may be performed to install embodiments of a coupling adapter 180 of the coupling assemblies 150 of the flow cross junction 130 previously described above and shown in FIGS. 5-20. Thus, in describing the method 300, continuing reference will be made to FIGS. 5-20. However, it should be appreciated that method 300 may be performed using features, components, and/or systems that are different in some respect(s) from those shown in FIGS. 5-20. Therefore, reference to the flow cross junction 130, fluid coupling assemblies 150, or other features shown in FIGS. 5-20 should not be interpreted as limiting other potential embodiments of method 300.

Initially, method 300 includes inserting a coupling adapter into an inlet flow bore of a flow cross junction of a manifold of a hydraulic fracturing system at block 302. For instance, as previously described and as may be appreciated from FIGS. 13, 15, and 16, a coupling adapter 180 may be inserted and threaded into the first inlet flow bore 134 via engagement of the threads 168, 190 such that the coupling adapter 180 is compressed into the first inlet flow bore 134 and particularly such that the inner end 180*b* of the coupling adapter 180 is compressed against the internal shoulder 166 within first inlet flow bore 134.

In addition, method 300 includes positioning a connection device of the coupling adapter outside of the inlet flow bore at block 304, wherein the connection device is to connect to an output of a pump of the hydraulic fracturing system. For instance, as may be appreciated from FIGS. 13, 15, and 16, once inserted into the first inlet flow bore 134, the connection device 188 of coupling adapter 180 is positioned outside the first inlet flow bore 134 along the radially outer surface 130*c* (particularly at the facet 138).

Further, method 300 includes compressing a retainer ring against an external shoulder of the coupling adapter at block 306. For instance, as previously described and as may be appreciated from FIGS. 13 and 18, the retainer ring 204 may be engaged with and compressed against an external shoulder 194 of on radially outer surface 180*c* of coupling adapter 180 to thereby prevent (or restrict) the rotation of the coupling adapter within the first inlet flow bore 134.

The embodiments disclosed herein include flow cross junctions for a manifold of a hydraulic fracturing system that include a streamlined shape and design so as to allow for a significant reduction in size and weight for the flow cross junctions and manifold overall. In addition, some embodiments of the flow cross junctions disclosed herein include fluid couplings that facilitate quick replacement in the event of a failure so as to minimize stoppage time. As a result, through use of the embodiments disclosed herein, a hydraulic fracturing operation may be conducted more safely and efficiently.

In some embodiments, the flow cross junction 130 may include one or more fluid ports for pressure and/or fluid communication with the inlet flow bores 134, 136. For instance, during operations, the one or more fluid ports may be used to inject an injectable sealant or packing (such as, polytetrafluoroethylene (PTFE), graphite, grease, polymer-based sealant, etc.) into the inlet flow bore 134, 136 so as to form an additional seal between the coupling adapters 180 and inlet flow bores 134, 136 during operations. For instance, the injectable sealant may be injected (via the one or more fluid flow ports) into the inlet flow bores 134, 136, axially between the annular seal members 199 (FIG. 13) either to prevent leakage of fracturing fluid when one or both of the annular seal members 199 has failed, or as a prophylactic measure. In some embodiments, the one or more fluid ports may also be used to test a sealing performance of the annular seal members 199. Specifically, a pressurized fluid may be injected via one or more of the one or more fluid ports, and a pressure of the fluid may be monitored. If the pressure of the injected fluid drops below a threshold, it may indicate that one or both of the annular seal members 199 has failed, thereby necessitating further corrective action (such as injecting the injectable sealant as previously described).

It should be appreciated that embodiments of the flow cross junctions may be utilized in other fluid services other than hydraulic fracturing operations. For instance, embodiments of the flow cross junctions disclosed herein may be utilized in fluid manifolds, lines, or other fluid conveyance systems and devices for transporting pressurized fluids both inside and outside of the oil and gas industry. Some particular examples include the use of embodiments of the flow cross junctions disclosed herein for flowing fluids for other oilfield operations (such as pump down, drilling mud delivery, production operations, etc.). In addition, it is also contemplated that embodiments of the flow cross junctions disclosed herein may be used in other fluid services, including those outside of the oil and gas industry.

The preceding discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the discussion herein and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, when used herein (including in the claims), the words "about," "generally," "substantially," "approximately," and the like, when used in reference to a stated value mean within a range of plus or minus 10% of the stated value.

This application is a continuation of U.S. Non-Provisional application Ser. No. 18/751,722, filed Jun. 24, 2024, titled "FLOW CROSS JUNCTIONS FOR A MANIFOLD OF A HYDRAULIC FRACTURING SYSTEM AND RELATED METHODS," now U.S. Pat. No. 12,228,024, issued Feb. 18, 2025, which is a continuation of U.S. Non-Provisional application Ser. No. 18/545,963, filed Dec. 19, 2023, titled "FLOW CROSS JUNCTIONS FOR A MANIFOLD OF A HYDRAULIC FRACTURING SYSTEM AND RELATED METHODS," now U.S. Pat. No. 12,044,113, issued Jul. 23, 2024, which claims priority to, and the benefit of U.S. Provisional Application No. 63/512,219, filed Jul. 6, 2023, titled "FLUID COUPLING ASSEMBLIES FOR A MANIFOLD OF A HYDRAULIC FRACTURING SYSTEM AND RELATED METHODS," U.S. Provisional Application No. 63/512,193, filed Jul. 6, 2023, titled "FLOW CROSS JUNCTIONS FOR A MANIFOLD OF A HYDRAULIC FRACTURING SYSTEM AND RELATED METHODS," U.S. Provisional Application No. 63/491,139, filed Mar. 20, 2023, titled "FLOW CROSS JUNCTIONS FOR A MANIFOLD OF A HYDRAULIC FRACTURING SYSTEM AND RELATED METHODS," and U.S. Provisional Application No. 63/476,438, filed Dec. 21, 2022, titled "FLUID COUPLING ASSEMBLIES FOR A MANIFOLD OF A HYDRAULIC FRACTURING SYSTEM AND RELATED METHODS," the disclosures of which are incorporated herein by reference in their entireties. U.S. Non-Provisional application Ser. No. 18/545,963 is also related to U.S. Non-Provisional application Ser. No. 18/545,946, filed Dec. 19, 2023, titled "FLUID COUPLING ASSEMBLIES FOR A MANIFOLD OF A HYDRAULIC FRACTURING SYSTEM AND RELATED METHODS," now U.S. Pat. No. 12,091,955, issued Sep. 17, 2024, the disclosure of which is incorporated herein by reference in its entirety.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method comprising:

(a) inserting a coupling adapter into an inlet flow bore of a flow cross junction of a manifold of a fluid system, the flow cross junction having one of a cylindrical outer surface or an outer surface having a polygonal cross-section;

(b) positioning a connection device of the coupling adapter outside of the inlet flow bore, the connection device to connect to an output of a pump of the fluid system;

(c) compressing a retainer ring within an annular groove of the coupling adapter, thereby to restrict an axial movement of the coupling adapter, the groove positioned external to the flow cross junction;

(d) connecting the retainer ring to the flow cross junction; and (e) compressing the coupling adapter into the inlet flow bore.

2. The method of claim 1, wherein step (c) comprises inserting a projection of the retainer ring into the annular groove of the coupling adapter.

3. The method of claim 1, further comprising:

(d) compressing the coupling adapter into an internal shoulder positioned within the inlet flow bore, and wherein the flow cross junction has an outer diameter greater than a length of the flow cross junction.

4. The method of claim 1, further comprising (d) threadedly engaging the coupling adapter within the inlet flow bore; and (e) connecting a plurality of ring segments, thereby to define the retainer ring.

5. A manifold of a fluid system, the manifold comprising:

a flow cross junction including an inlet flow bore, the flow cross junction having an outer diameter greater than a length of the flow cross junction;

a coupling adapter including an annular groove and a connection device, the connection device to connect to an output of a pump of the fluid system, and the coupling adapter inserted within the inlet flow bore such that the connection device and the groove are positioned outside of the inlet flow bore and positioned external to the flow cross junction; and a retainer ring connected to the flow cross junction and compressed within the annular groove.

6. The manifold of claim 5, wherein the retainer ring comprises (a) a plurality of ring segments positioned circumferentially around the coupling adapter, and (b) a projection positioned within the annular groove when installed.

7. The manifold of claim 5, wherein the inlet flow bore comprises an internal shoulder, wherein an end of the coupling adapter is compressed against the internal shoulder, wherein the flow cross junction has one of a cylindrical outer surface or an outer surface having a polygonal cross-section, and wherein the coupling adapter is threadably engaged within the inlet flow bore.

8. The manifold of claim 5, further comprising a first elongate manifold section and a second elongate manifold section, wherein the flow cross junction is positioned between the first elongate manifold section and the second elongate manifold section along a longitudinal axis, and wherein the flow cross junction includes:

an upstream end connected to the first elongate manifold section via a first connection, and a downstream end spaced from the upstream end along the longitudinal axis and connected to the second elongate manifold section via a second connection.

9. The manifold of claim 8, wherein the first connection and the second connection each include flanged connections, and the manifold further comprising a coupling adapter including a connection device, the connection device to connect to an output of a pump of a fluid system, and wherein the coupling adapter is positioned within the inlet flow bore such that the connection device is positioned outside of the inlet flow bore.

10. The manifold of claim 9, wherein the coupling adapter is positioned within the inlet flow bore to compress an end of the coupling adapter into the inlet throughbore, wherein the inlet flow bore comprises an internal shoulder, and wherein the end of the coupling adapter is compressed against the internal shoulder.

11. The manifold of claim 8, wherein the flow cross junction includes a plurality of inlet flow bores extending between an outer surface and a throughbore, and wherein the inlet flow bore comprises one of the plurality of inlet flow bores, and the manifold further comprising a plurality of coupling adapters positioned within the plurality of inlet flow bores, and wherein each of the plurality of coupling adapters includes a connection device to connect to an output of a corresponding pump of a hydraulic fracturing system.

12. A flow cross junction for a manifold of a fluid system, the flow cross junction comprising:

an upstream end configured to connect with a first elongate manifold section;

a downstream end spaced from the upstream end along a longitudinal axis to define an axial length of the flow cross junction measured axially from the upstream end to the downstream end, the downstream end configured to connect to a second elongate manifold section;

a throughbore extending axially between the upstream end to the downstream end;

an outer surface extending axially between the upstream end to the downstream end, the outer surface having an outer diameter greater than the axial length of the flow cross junction; and a retainer ring to connect to the flow cross junction and compress against a groove of a coupling adapter, the groove positioned external to the flow cross junction.

13. The flow cross junction of claim 12, wherein the retainer ring comprises (a) a plurality of ring segments positioned circumferentially around the coupling adapter, and (b) a projection positioned within the groove when installed.

14. The flow cross junction of claim 12, further comprising a plurality of inlet flow bores to extend between an outer surface of the flow cross junction and the throughbore, and wherein the inlet flow bore comprises one of the plurality of inlet flow bores.

15. The flow cross junction of claim 12, wherein the outer surface includes a cylindrical surface or a polygonal surface, and wherein the coupling adapter is threadedly engaged within an inlet flow bore.

16. The flow cross junction of claim 12, further comprising:

an inlet flow bore extending from the outer surface to the throughbore; and a coupling adapter including a connection device, the connection device to connect to an output of a pump of the fluid system, and the coupling adapter inserted within the inlet flow bore and such that the connection device is positioned outside of the inlet flow bore.

17. The flow cross junction of claim 16, wherein the coupling adapter is positioned within the inlet flow bore to compress an end of the coupling adapter into the throughbore, and wherein the inlet flow bore comprises an internal shoulder and the end of the coupling adapter is compressed against the internal shoulder.

18. A manifold of a fluid system, the manifold comprising:

a first elongate manifold section;

a second elongate manifold section;

a flow cross junction including an inlet flow bore and positioned between the first elongate manifold section and the second elongate manifold section along a longitudinal axis, the flow cross junction also including:

an upstream end connected to the first elongate manifold section via a first connection, and a downstream end spaced from the upstream end along the longitudinal axis and connected to the second elongate manifold section via a second connection;

a coupling adapter including a groove and a connection device, the connection device to connect to an output of a pump of the fluid system, and the coupling adapter inserted within the inlet flow bore such that the connection device and the groove are positioned outside of the inlet flow bore; and a retainer ring positioned in the groove to fasten the coupling adapter to the flow cross junction.

19. The manifold of claim 18, wherein the retainer ring comprises a plurality of ring segments positioned circumferentially around the coupling adapter.

20. The manifold of claim 18, wherein the inlet flow bore comprises an internal shoulder, and wherein an end portion of the coupling adapter is configured to compress against the internal shoulder.

21. A manifold of a fluid system, the manifold comprising:

a first elongate manifold section;

a second elongate manifold section;

a flow cross junction including an inlet flow bore and positioned between the first elongate manifold section and the second elongate manifold section along a longitudinal axis, the flow cross junction also including:

an upstream end connected to the first elongate manifold section via a first connection, and a downstream end spaced from the upstream end along the longitudinal axis and connected to the second elongate manifold section via a second connection;

a coupling adapter including a groove and a connection device, the connection device to connect to an output of a pump of the fluid system, and the coupling adapter inserted within the inlet flow bore such that the connection device and the groove are positioned outside of the inlet flow bore; and a retainer ring having a projection configured to contact the groove to fasten the coupling adapter to the flow cross junction and a plurality of ring segments positioned circumferentially around the coupling adapter.

* * * * *